US008125148B2

(12) United States Patent
Kim et al.

(10) Patent No.: US 8,125,148 B2
(45) Date of Patent: Feb. 28, 2012

(54) PLASMA DISPLAY PANEL WITH A DEFINED RELATIONSHIP BETWEEN AN EXHAUST HOLE CIRCUMFERENTIAL LENGTH AND DISTANCES BETWEEN MAIN AND SEPARATION BARRIER RIBS AND SEAL LAYER STRUCTURES

(75) Inventors: Wontae Kim, Gumi (KR); Hungun Park, Gumi (KR); Younjin Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 121 days.

(21) Appl. No.: 12/730,448

(22) Filed: Mar. 24, 2010

(65) Prior Publication Data

US 2010/0244684 A1 Sep. 30, 2010

(30) Foreign Application Priority Data

Mar. 25, 2009 (KR) ..... 10-2009-0025383
Mar. 9, 2010 (KR) ..... 10-2010-0020958

(51) Int. Cl.
*H01J 17/49* (2006.01)

(52) U.S. Cl. ..... 313/582; 313/586; 313/583

(58) Field of Classification Search ..... 313/582–587; 445/24, 25

See application file for complete search history.

(56) References Cited

U.S. PATENT DOCUMENTS

2006/0066238 A1* 3/2006 Woo ..... 313/582
2007/0046205 A1* 3/2007 Kwon et al. ..... 313/582
2008/0042566 A1* 2/2008 Song et al. ..... 313/582
2010/0237776 A1* 9/2010 Kim et al. ..... 313/582

FOREIGN PATENT DOCUMENTS

KR 2008094276 A * 10/2008

* cited by examiner

*Primary Examiner* — Mariceli Santiago
(74) *Attorney, Agent, or Firm* — Ked & Associates LLP

(57) ABSTRACT

A plasma display panel includes a front substrate, a rear substrate arranged to face the front substrate, barrier ribs for partitioning discharge cells between the front substrate and the rear substrate, and an exhaust hole formed on the rear substrate in an area between the barrier ribs and the seal layer. A distance between the outermost barrier rib and the seal layer is less than a circumferential length of the exhaust hole.

10 Claims, 21 Drawing Sheets

(a)

(b)

PLASMA DISPLAY PANEL WITH A DEFINED RELATIONSHIP BETWEEN AN EXHAUST HOLE CIRCUMFERENTIAL LENGTH AND DISTANCES BETWEEN MAIN AND SEPARATION BARRIER RIBS AND SEAL LAYER STRUCTURES

This application claims the benefit of Korean Patent Application Nos. 10-2009-0025383 filed on Mar. 25, 2009 and 10-2010-0020958 filed on Mar. 9, 2010, the entire contents of which is incorporated herein by reference for all purposes as if fully set forth herein.

BACKGROUND

1. Field

This document relates to a plasma display panel.

2. Related Art

A plasma display panel includes a phosphor layer formed inside discharge cells partitioned by barrier ribs and a plurality of electrodes.

When driving signals are applied to the electrodes of the plasma display panel, a discharge occurs inside the discharge cell due to the supplied driving signals. In other words, when the discharge occurs inside the discharge cell due to the supplied driving signals, a discharge gas filled in the discharge cell generates vacuum ultraviolet rays, which thereby cause a phosphor inside the discharge cell to emit light, thus producing visible light. An image is displayed on the screen of the plasma display panel due to the visible light.

SUMMARY

In one aspect, there is a plasma display panel comprising a front substrate, a rear substrate arranged to face the front substrate, barrier ribs for partitioning discharge cells between the front substrate and the rear substrate, and an exhaust hole formed on the rear substrate in an area between the barrier ribs and the seal layer, wherein a distance between the outermost barrier rib and the seal layer is less than a circumferential length of the exhaust hole.

In another aspect, there is a plasma display panel comprising a front substrate, a rear substrate arranged to face the front substrate, barrier ribs for partitioning discharge cells between the front substrate and the rear substrate, a separation barrier rib arranged between the barrier ribs and the seal layer and spaced apart from the seal layer and the barrier ribs, and an exhaust hole formed on the rear substrate in an area between the barrier ribs and the seal layer, wherein the sum of a distance between the outermost barrier rib and the separation barrier rib and a distance between the separation barrier rib and the seal layer is less than a circumferential length of the exhaust hole.

In another aspect, there is a plasma display panel comprising a front substrate on which first electrodes are arranged, a rear substrate on which second electrodes are arranged to cross the first electrodes, barrier ribs for partitioning discharge cells between the front substrate and the rear substrate, a seal layer for bonding the front substrate and the rear substrate together, and an exhaust hole formed on the rear substrate in an area between the barrier ribs and the seal layer, wherein a distance, parallel to the first electrodes, between the outermost barrier rib and the seal layer is less than a distance, parallel to the second electrodes, between the outermost barrier rib and the seal layer.

DETAILED DESCRIPTION

Figure 1:
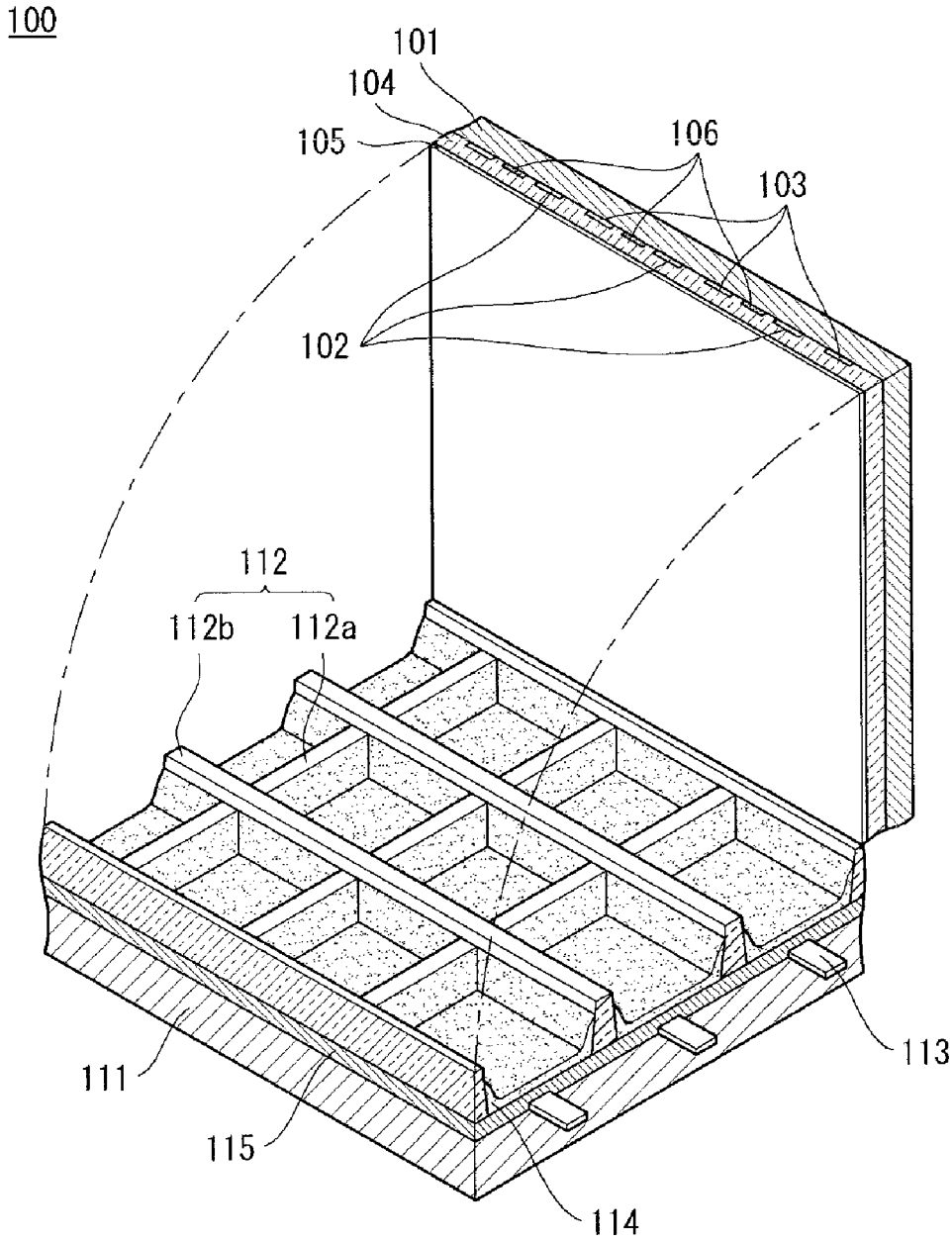
FIG. 1 is a diagram for explaining a structure of a plasma display panel.

Since the present invention may be modified in various ways and may have various forms, specific embodiments are illustrated in the drawings and are described in detail in the present specification. However, it should be understood that the present invention are not limited to specific disclosed embodiments, but include all modifications, equivalents and substitutes included within the spirit and technical scope of the present invention. In the description of each drawing, the same reference characters are used to designate the same or similar components.

The terms 'first', 'second', etc. may be used to describe various components, but the components are not limited by such terms. The terms are used only for the purpose of distinguishing one component from other components. For example, a first component may be designated as a second component without departing from the scope of the present invention. In the same manner, the second component may be designated as the first component.

The term "and/or" encompasses both combinations of the plurality of related items disclosed and any item from among the plurality of related items disclosed.

When an arbitrary component is described as "being connected to" or "being linked to" another component, this should be understood to mean that still another component may exist between them, although the arbitrary component may be directly connected to, or linked to, the second component. In contrast, when an arbitrary component is described as "being directly connected to" or "being directly linked to" another component, this should be understood to mean that no component exists between them.

The terms used in the present application are used to describe only specific embodiments, and are not intended to limit the present invention. A singular expression includes a plural expression as long as it does not have an apparently different meaning in context.

In the present application, the terms "include" and "have" should be understood to be intended to designate that illustrated features, numbers, steps, operations, components, parts or combinations thereof exist and not to preclude the existence of one or more different features, numbers, steps, operations, components, parts or combinations thereof, or the possibility of the addition thereof.

Unless otherwise specified, all of the terms which are used herein, including the technical or scientific terms, have the same meanings as those that are generally understood by a person having ordinary knowledge in the art to which the present invention pertains. The terms defined in a generally used dictionary must be understood to have meanings identical to those used in the context of a related art, and are not to be construed to have ideal or excessively formal meanings unless they are obviously specified in the present application.

The following exemplary embodiments of the present invention are provided to those skilled in the art in order to describe the present invention more completely. Accordingly, shapes and sizes of elements shown in the drawings may be exaggerated for clarity.

FIG. 1 is a diagram for explaining a structure of a plasma display panel.

Referring to FIG. 1, a plasma display panel 100 may comprise a front substrate 101, on which a plurality of display electrodes 102 and 103 are positioned, and a rear substrate 111 on which an address electrode 113 (X) is positioned to intersect the display electrodes 111.

The display electrodes 102 and 103 may be a scan electrode 102 (Y) and a sustain electrode 103 (Z). Also, the display electrodes 102 and 103 may be referred to as first electrodes.

An upper dielectric layer 104 may be positioned on the display electrodes 102 and 103, i.e., the scan electrode 102 (Y) and the sustain electrode 103 (Z) to limit a discharge current of the scan electrode 102 (X) and the sustain electrode 103 (Z) and to provide electrical insulation between the scan electrode 102 (X) and the sustain electrode 103 (Z).

A protective layer 105 may be positioned on the upper dielectric layer 104 to facilitate discharge conditions. The protective layer 105 may include a material having a high secondary electron emission coefficient, for example, magnesium oxide (MgO).

The address electrode 113 (X) is formed on the rear substrate 111, and a lower dielectric layer 115 may be positioned on the address electrode 113 (X) to provide electrical insulation of the address electrodes 113 (X). Also, the address electrodes 113 may be referred to as second electrodes.

Barrier ribs 112 of a stripe type, a well type, a delta type, a honeycomb type, and the like may be positioned on the lower dielectric layer 115 to partition discharge spaces (i.e., discharge cells). Hence, a first discharge cell emitting red (R) light, a second discharge cell emitting blue (B) light, and a third discharge cell emitting green (G) light, and the like, may be formed between the front substrate 101 and the rear substrate 111.

The barrier rib 112 includes first and second barrier ribs 112*a* and 112*a* crossing each other. Heights of the first and second barrier ribs 112*a* and 112*b* may be different from each other. The first barrier rib 112*a* may be parallel to the scan electrode 102 and the sustain electrode 103, and the second barrier rib 112*b* may be parallel to the address electrode 113.

The height of the first barrier rib 112*a* may be less than the height of the second barrier rib 112*b*. Hence, in an exhaust process and a process for injecting a discharge gas, an impurity gas in the panel may be efficiently exhausted to the outside of the panel, and the discharge gas may be uniformly injected.

Each of the discharge cells partitioned by the barrier ribs 112 may be filled with the discharge gas.

A phosphor layer 114 may be formed inside the discharge cells partitioned by the barrier ribs 112 to emit visible light for an image display during an address discharge. For example, first, second, and third phosphor layers that respectively generate red, blue, and green light may be formed inside the discharge cells.

Although the above description illustrates a case where the upper dielectric layer 104 and the lower dielectric layer 115 each are formed in the form of a single layer, at least one of the upper dielectric layer 104 and the lower dielectric layer 115 may be formed in the form of a plurality of layers.

While the address electrode 113 formed on the rear substrate 111 may have a substantially constant width or thickness, a width or thickness of the address electrode 113 inside the discharge cell may be different from a width or thickness of the address electrode 113 outside the discharge cell. For example, a width or thickness of the address electrode 113 inside the discharge cell may be greater than a width or thickness of the address electrode 113 outside the discharge cell.

When a predetermined signal is supplied to at least one of the scan electrode 102, the sustain electrode 103, and the address electrode 113, a discharge may occur inside the discharge cell. The discharge may allow the discharge gas filled in the discharge cell to generate ultraviolet rays. The ultraviolet rays may be incident on phosphor particles of the phosphor layer 114, and then the phosphor particles may emit visible light. Hence, an image may be displayed on the screen of the plasma display panel 100.

Figure 2:
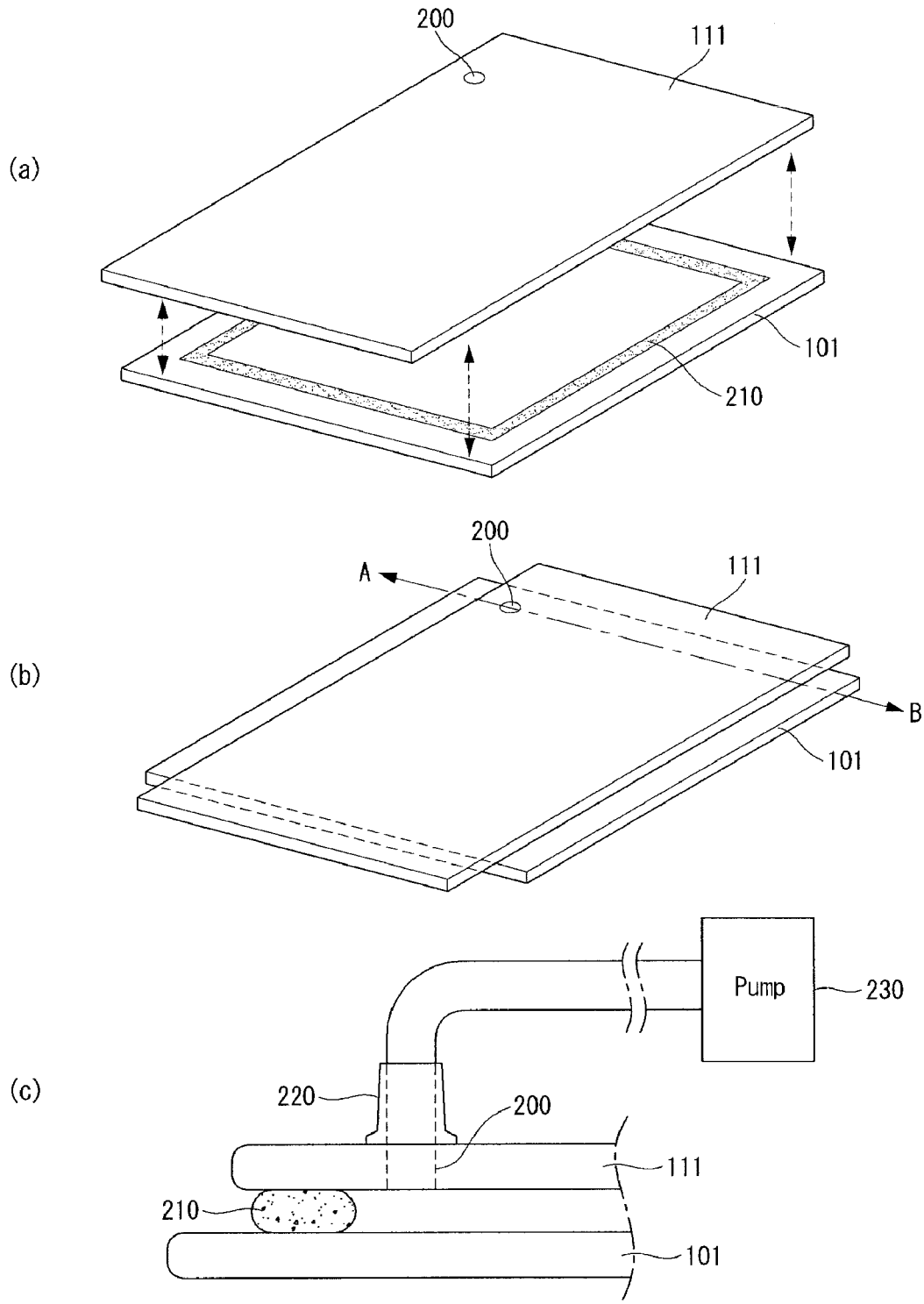
FIG. 2 is a diagram for schematically explaining a method of manufacturing a plasma display panel.

FIG. 2 is a diagram for schematically explaining a method of manufacturing a plasma display panel.

Referring to FIG. 2, first, a seal layer 210 may be formed at an edge of at least one of the front substrate 101 and the rear substrate 111 having an exhaust hole 200 formed therethrough as shown in (a), and the front substrate 101 and the rear substrate 111 may be bonded together using the seal layer 210 as shown in (b).

Thereafter, as shown in (b), an exhaust tip 220 may be connected to the exhaust hole 200 and an exhaust pump 230 may be connected to the exhaust tip 220.

Then, impurity gases remaining in the discharge space between the front substrate 101 and the rear substrate 111 may be exhausted outside using the exhaust pump 230. Also, a discharge gas such as argon (Ar), neon (Ne), xenon (Xe), etc. may be injected into the discharge space.

FIGS. 3 to 7 are diagrams for explaining a relationship between a distance between a seal layer and an outermost barrier rib and a circumferential length of an exhaust hole. Although the exhaust hole 200 may be formed in the front substrate 101 as well and the exhaust hole 200 may be provided in plural number, the following description will be made with respect to a case where the exhaust hole 200 is formed in the rear substrate 111 and there is only one exhaust hole 200. Alternatively, the exhaust hole 200 may be formed on the front substrate 101 and the rear substrate 111, respectively.

Figure 3:
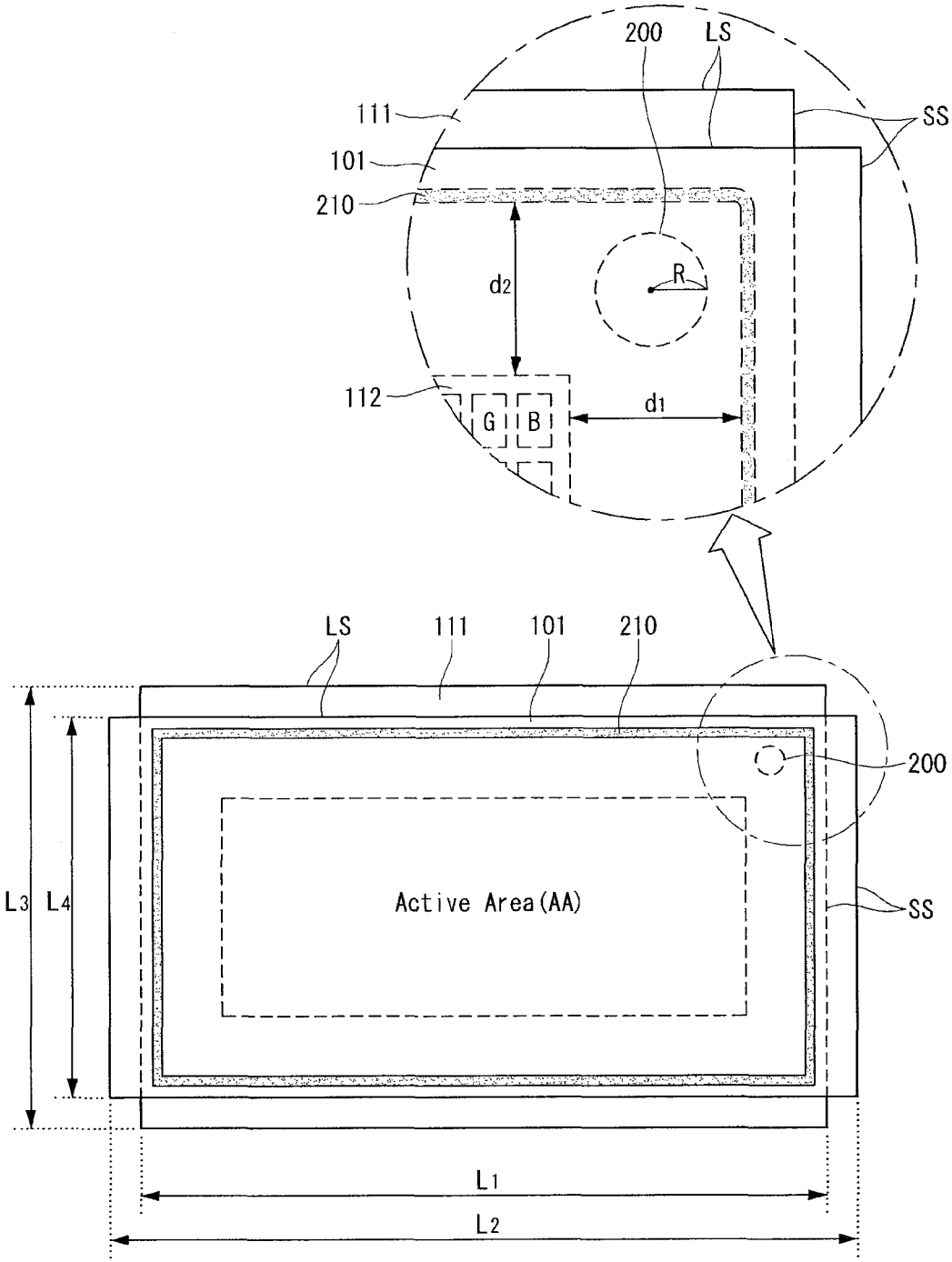
FIGS. 3 to 7 are diagrams for explaining a relationship between a distance between a seal layer and an outermost barrier rib and a circumferential length of an exhaust hole.

First, referring to FIG. 3, a long side LS of the rear substrate 111 may have a length L1, and a short side SS thereof may have a length L3 which is less than the length L1.

Moreover, a long side LS of the front substrate 101 has a length L2 which is greater than the length L1, and a short side SS thereof has a length L4 which is less than the length L3.

That is, the long side of the rear substrate 111 may protrude further than the long side of the front substrate 101, and the short side of the front substrate 101 may protrude further than the short side of the rear substrate 111.

In this way, the front substrate 101 and the rear substrate 111 are alternately arranged so that a driving device for supplying driving signals to the plasma display panel 100 is connected to the scan electrode (Y), the sustain electrode (Z), or the address electrode (X).

The exhaust hole 200 may be arranged in an area between the seal layer 210 and the barrier rib 112.

The barrier rib 112 may be spaced apart from the seal layer 210 by d1 on the short sides SS of the front substrate 101 and rear substrate 111, and may be spaced apart from the seal layer 210 by d2 on the long sides of the front substrate 101 and rear substrate 111. That is, a distance between the outermost barrier rib 112 and the seal layer 210 on the short sides SS of the front substrate 101 and rear substrate 111 is d1, and a distance between the outermost barrier rib 112 and the seal layer 210 on the long sides LS of the front substrate 101 and rear substrate 111 is d2.

The distances d1 and d2 may be equal to or different from each other.

Also, the distance d1 and d2 between the outermost barrier rib 112 and the seal layer 210 may be less than or equal to a circumferential length of the exhaust hole 200.

Figure 4:
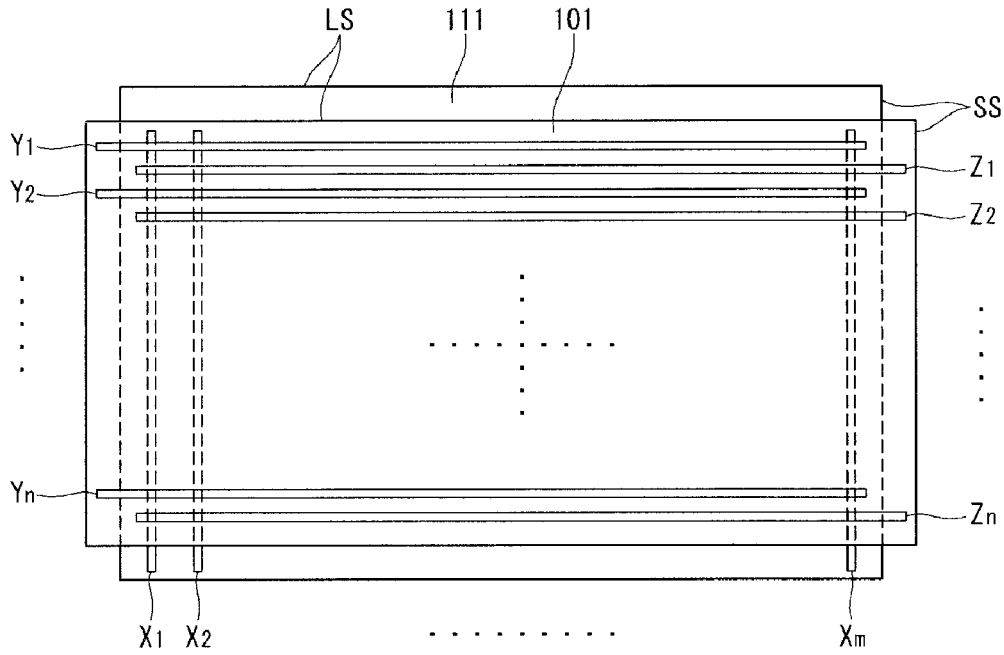

For example, the distance d1 between the outermost barrier rib 112 and the seal layer 210 on the short sides SS of the front substrate 101 and rear substrate 111 may be less than the circumferential length of the exhaust hole 200, and the distance d2 between the outermost barrier rib 112 and the seal layer 210 on the long sides LS of the front substrate 101 and rear substrate 111 may be greater than the circumferential length of the exhaust hole 200. As shown in FIG. 4, the first electrodes Y1-Yn and Z1-Zn may be arranged parallel to the long sides LS of the front substrate 101 and rear substrate 111, and the second electrodes X1-Xn may be arranged parallel to the short sides SS of the front substrate 101 and rear substrate 111. That is, the first electrodes are arranged transversely arranged on the panel, and the second electrodes are arranged longitudinally arranged on the panel. In view of this, the distance d1, parallel to the first electrodes, between the outermost barrier rib 112 and the seal layer 210 may be less than the circumferential length of the exhaust hole 200, and the distance d2, parallel to the second electrodes, between the outermost barrier rib 112 and the seal layer 210 may be greater than the circumferential length of the exhaust hole 200.

Alternatively, the distance d1 between the outermost barrier rib 112 and the seal layer 210 on the short sides SS of the front substrate 101 and rear substrate 111 may be greater than the circumferential length of the exhaust hole 200, and the distance d2 between the outermost barrier rib 112 and the seal layer 210 on the long sides LS of the front substrate 101 and rear substrate 111 may be less than the circumferential length of the exhaust hole 200.

Alternatively, the distance d1 between the outermost barrier rib 112 and the seal layer 210 on the short sides SS of the front substrate 101 and rear substrate 111 and the distance d2 between the outermost barrier rib 112 and the seal layer 210 on the long sides LS of the front substrate 101 and rear substrate 111 each may be less than the circumferential length of the exhaust hole 200. If the exhaust hole 200 has a spherical shape with a radius of R, the circumferential length of the exhaust hole 200 is 2nR.

As above, if at least one of d1 and d2 is set smaller than the circumferential length of the exhaust hole 200, the size of a bezel can be reduced. Also, an excessive increase in the processing time during the exhaust process or the gas injection process can be prevented.

Also, it may be preferable that at least one of d1 and d2 is greater than the radius 2R of the exhaust hole 200 even if at least one of d1 and d2 is less than the circumferential length of the exhaust hole 200.

Figure 5:
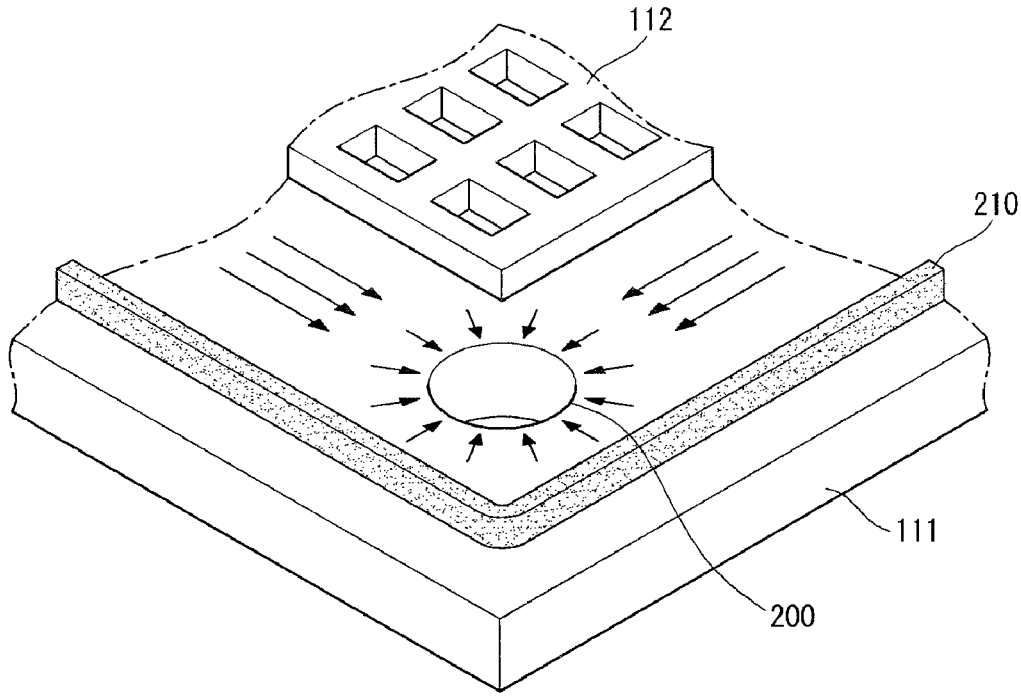

During the exhaust process in the manufacturing process of the plasma display panel, as shown in FIG. 5, the gas in the panel can be exhausted to the outside of the panel by being moved toward the exhaust hole 200 through a space between the barrier rib 112 and the seal layer 210.

The gas moved toward the exhaust hole 200 can be exhausted outside in such a manner as to flow along the edge of the exhaust hole 200 as indicated in the arrows in FIG. 5.

As such, when the gas in the panel is exhausted to the outside of the panel, it flows along the edge of the exhaust hole 200. Therefore, the exhaust characteristics may depend on the circumferential length of the exhaust hole 200.

Also, the exhaust characteristics may depend on the size of a path through which the gas can pass, i.e., a space between the outermost barrier rib 112 and the seal layer 210.

Meanwhile, if the distance between the outermost barrier rib 112 and the seal layer 210 is excessively large, with the circumferential length of the exhaust hole 200 being fixed, the size of an unnecessary area, i.e., the size of the bezel, becomes excessively large, thus increasing manufacturing costs.

Figure 6:
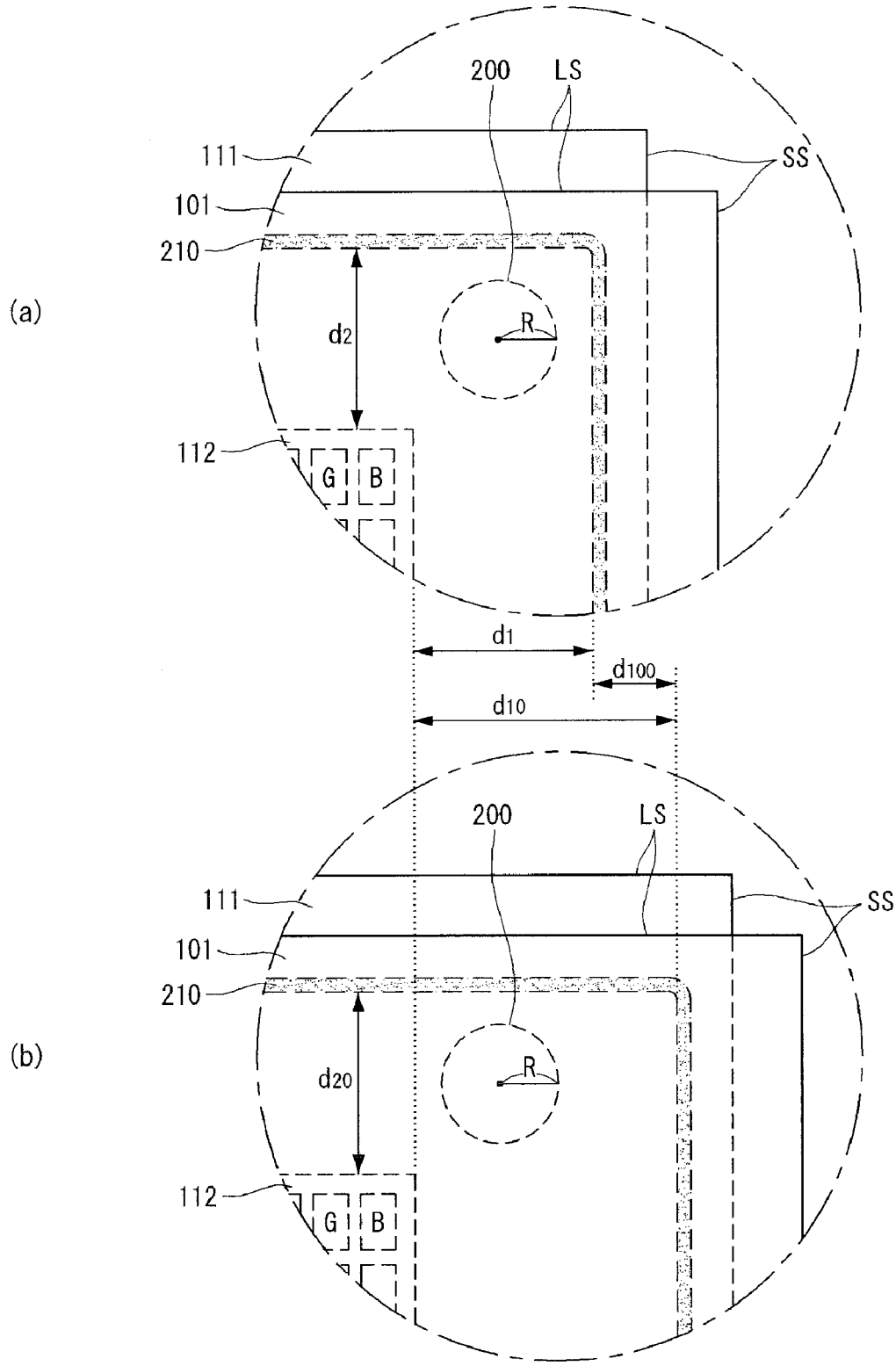

For instance, as shown in (a) of FIG. 6, it is assumed that, in a first exemplary embodiment, the distance d1 and d2 between the outermost barrier rib 112 and the seal layer 210 is less than the circumferential length of the exhaust hole 200.

Also, as shown in (b) of FIG. 6, it is assumed that, in a first comparative example, distance d10 and d20 between the outermost barrier rib 112 and the seal layer 210 is approximately twice as large as the circumferential length of the exhaust hole 200.

The exhaust characteristics of the first exemplary embodiment and the first comparative example will be discussed below.

In comparing the first exemplary embodiment and the first comparative example, the time required to exhaust the gas in the panel to a vacuum pump and reduce the internal pressure to a critical degree of vacuum in the first exemplary embodiment according to the present invention may be substantially equal to that in the first comparative example. The reason for this is that, as explained above in FIG. 5, the exhaust characteristics may depend on the circumferential length of the exhaust hole 200 because the gas in the panel flows along the edge of the exhaust hole 200 when exhausted outside, and as a result, as shown in (b) of FIG. 6, the degree of improvement of the exhaust characteristics is small even if the distance d10 and d20 between the outermost barrier rib 112 and the seal layer 210 is greater than the circumferential length of the exhaust hole 200.

Meanwhile, in the first exemplary embodiment according to the present invention of (a) of FIG. 6, the distance d1 and/or d2 between the outermost barrier rib 112 and the seal layer 210 can be set smaller than the distance d10 and d20 of the first exemplary embodiment of (b) of FIG. 6.

In comparing (a) and (b) of FIG. 6, in the first comparative example, an unconditional increase in the distance d10 and/or d20 between the outermost barrier rib 112 and the seal layer 210 may only lead to an increase in the size of the bezel area without significant improvement in the exhaust characteristics.

That is, as shown in (a) of FIG. 6, if the distance d1 and/or di2 between the outermost barrier rib 112 and the seal layer 210 is set substantially equal to or less than the circumferential length of the exhaust hole 200, a degradation of the exhaust characteristics can be prevented and the size of the bezel area can be reduced.

Also, the exhaust characteristics may depend on the size of a path through which the gas can pass, i.e., a space between the outermost barrier rib 112 and the seal layer 210. Hence, in order to prevent an excessive degradation of the exhaust characteristics, it may be preferable that the distances d1 and d2, parallel to the first electrodes and the second electrodes, respectively, between the outermost barrier rib 112 and the seal layer 210 are larger than the diameter 2R of the exhaust hole 200.

Also, it may be preferable that at least one of d1 and d2 is larger than the diameter 2R of the exhaust hole 200 even if the at least one of d1 and d2 is less than the circumferential length of the exhaust hole 200.

Figure 7:
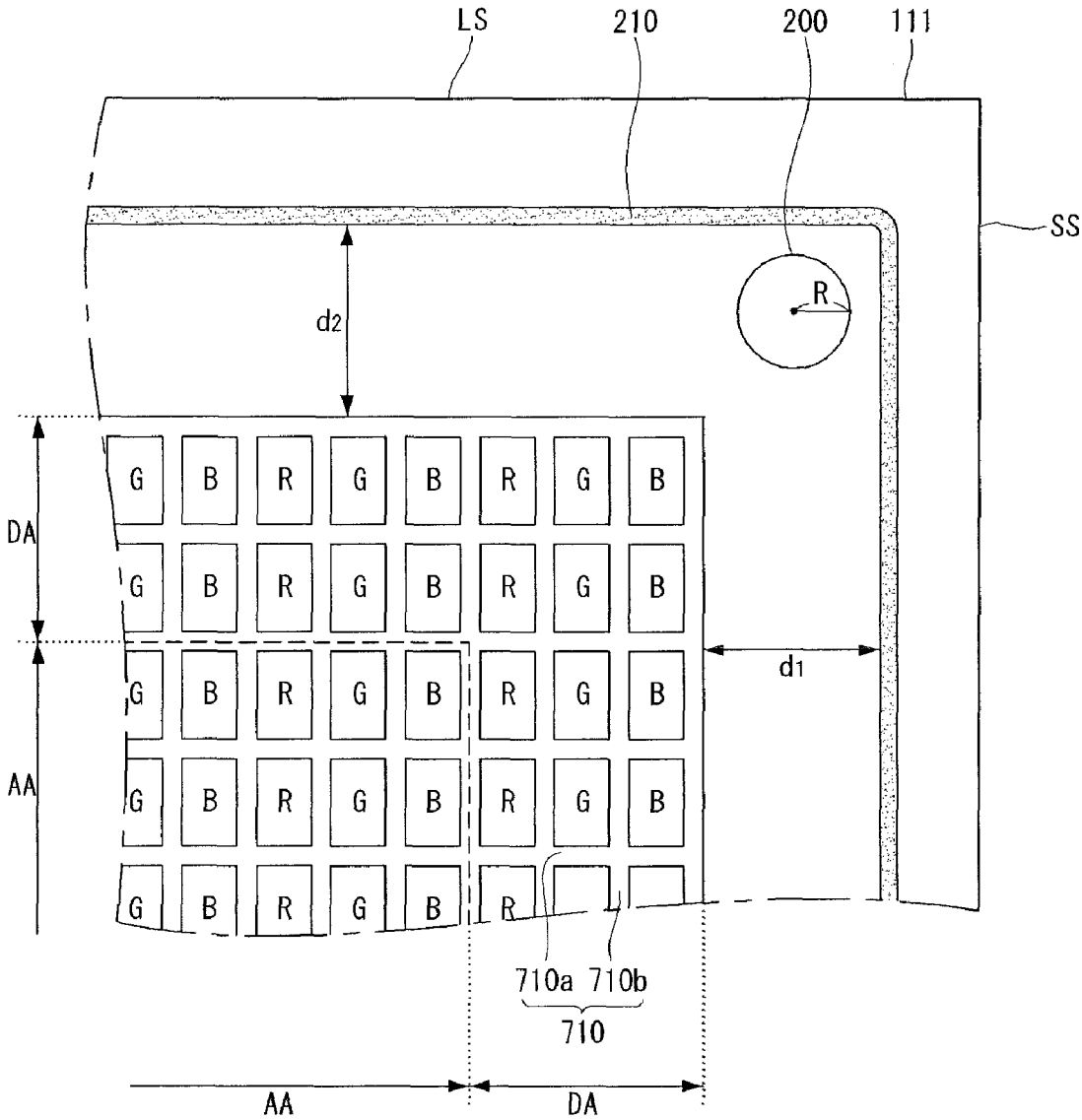

Moreover, as shown in FIG. 7, dummy barrier ribs 710 may be arranged in a dummy area DA outside an active area AA.

The active area AA may be an image display area. The description of the parts having been described above in detail will be omitted in FIG. 7.

For example, active barrier ribs for partitioning active discharge cells are arranged in the active area between the front substrate 101 and the rear substrate, and dummy barrier ribs 710 for partitioning dummy discharge cells are arranged in the dummy area DA outside the active area AA.

As such, when the dummy barrier ribs 710 are formed in the dummy area DA, a buffer zone can be provided between the active area AA and the seal layer 210, thereby preventing damage of the active barrier ribs 112 formed in the active area AA and improving discharge characteristics of the discharge cells partitioned by the active barrier ribs 112.

The barrier ribs arranged in the active area are referred to as the active barrier ribs and the barrier ribs arranged in the dummy area are referred to as the dummy barrier ribs 710 so as to differentiate the dummy area from the active area. The dummy barrier ribs 710 and the active barrier ribs may be formed of substantially the same material, and may have the same shape. Of course, the dummy barrier ribs 710 and the active barrier ribs may include different materials from each other or may have different shapes from each other.

As shown in FIG. 7, in the case where the dummy barrier ribs 710 are arranged in the dummy area DA, the outermost barrier rib is an outermost dummy barrier rib 710. The arrangement of the dummy barrier ribs 710 may be substantially equal to that in FIG. 3 except that the dummy barrier ribs 710 are added in the dummy area DA. For example, it may be preferable that the distance d1 and/or d2 between the outermost dummy barrier rib 710 and the seal layer 210 is less than the circumferential length of the exhaust hole 200.

FIGS. 8 to 13 are diagrams for explaining another structure of a plasma display panel according to the present invention. The description of the parts having been described above in detail will be omitted below.

Figure 8:
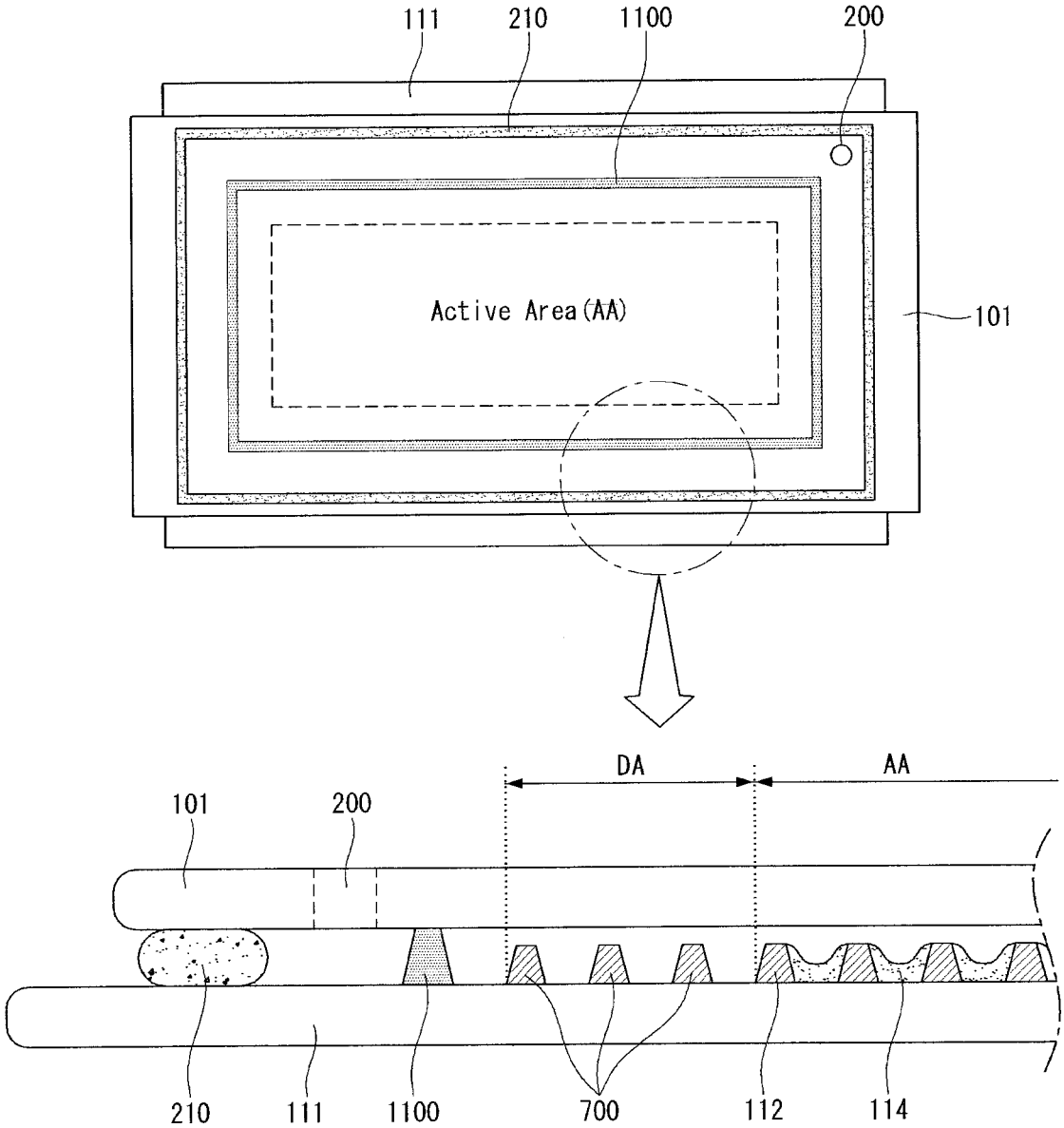
FIGS. 8 to 13 are diagrams for explaining another structure of a plasma display panel according to the present invention.

First, referring to FIG. 8, a separation barrier rib 1100 for preventing intrusion of the seal layer 210 into the active area AA may be further arranged between the active area AA and the seal layer 210.

That is, the separation barrier rib 1100 is arranged between the barrier ribs 112 partitioning the discharge cells in the active area AA and the seal layer 210. The separation barrier rib 1100 of this type may be referred to as a seal barrier rib SBR.

The separation barrier rib 1100 may be structurally spaced apart from the barrier ribs 112. Also, the separation barrier rib 1100 may be spaced apart from the seal layer 210. Alternatively, the separation barrier rib 1100 may be contacted with the seal layer 210.

In this manner, once the separation barrier rib 1100 is formed, the distance between the front substrate 101 and the rear substrate 111 may be kept substantially constant, thus enabling reduction of noise.

Figure 9:
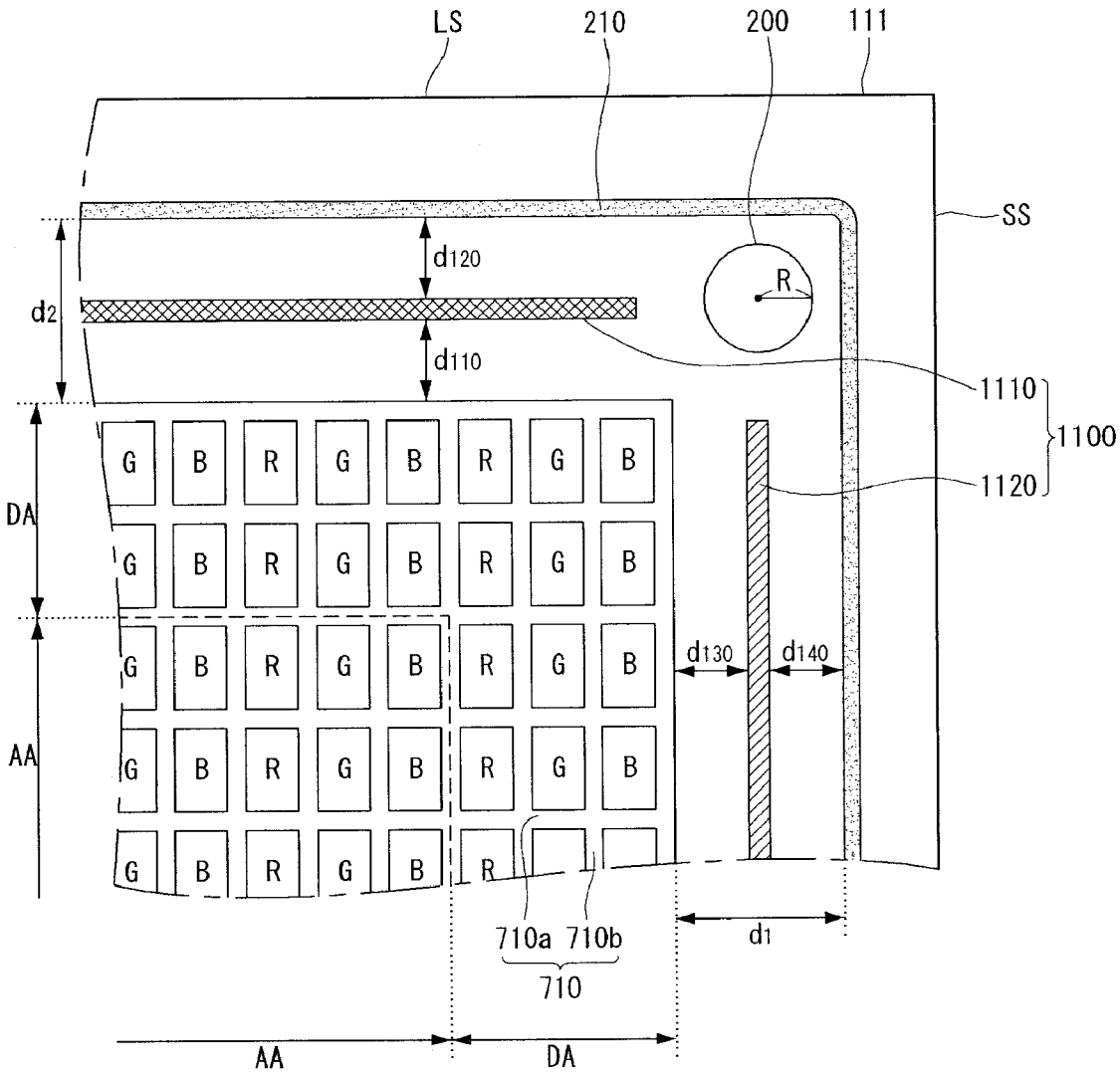

Also, as shown in FIG. 9, in the case where the dummy barrier ribs 710 are arranged in the dummy area DA, the separation barrier rib 1100 may be arranged between the dummy barrier ribs 710 and the seal layer 210. Moreover, the separation barrier rib 1100 may be spaced apart from the dummy barrier ribs 710.

When the separation barrier rib 1100 is formed as explained above, the exhaust hole 200 may be arranged in an area between the seal layer 210 and the separation barrier rib 1100.

Alternatively, the exhaust hole 200 may overlap with the separation barrier rib 1100 in a direction parallel to the long side LS of the rear substrate 111 and/or in a direction parallel to the short side SS of the rear substrate 111. In other words, though not shown, the exhaust hole 200 may overlap with an extension line of the separation barrier rib 1100 in a direction parallel to the long side LS of the rear substrate 111 and/or in a direction parallel to the short side SS of the rear substrate 111.

In this way, if the separation barrier rib 1100 is arranged, the sum d130+d140 and/or d110+d120 of the distance d3*a* and d4*a* between the outermost dummy barrier rib 710 and the separation barrier rib 1100 and the distance d3*b* and d4*b* between the separation barrier rib 1100 and the seal layer 210 may be less than the circumferential length of the exhaust hole 200. Preferably, the distance d1 and/or d2 between the outermost barrier rib 112 (in FIG. 9, the outermost barrier rib is the outermost dummy barrier rib 710) and the seal layer 210 may be less than the circumferential length of the exhaust hole 200. Here, unexplained reference numeral 1110 may be a second separation barrier rib, and unexplained reference numeral 1120 may be a first separation barrier rib.

In this case, too, it is possible to prevent a degradation of the exhaust characteristics and reduce the size of the bezel area.

Meanwhile, the position of the exhaust hole 200 may be changed.

Figure 10:
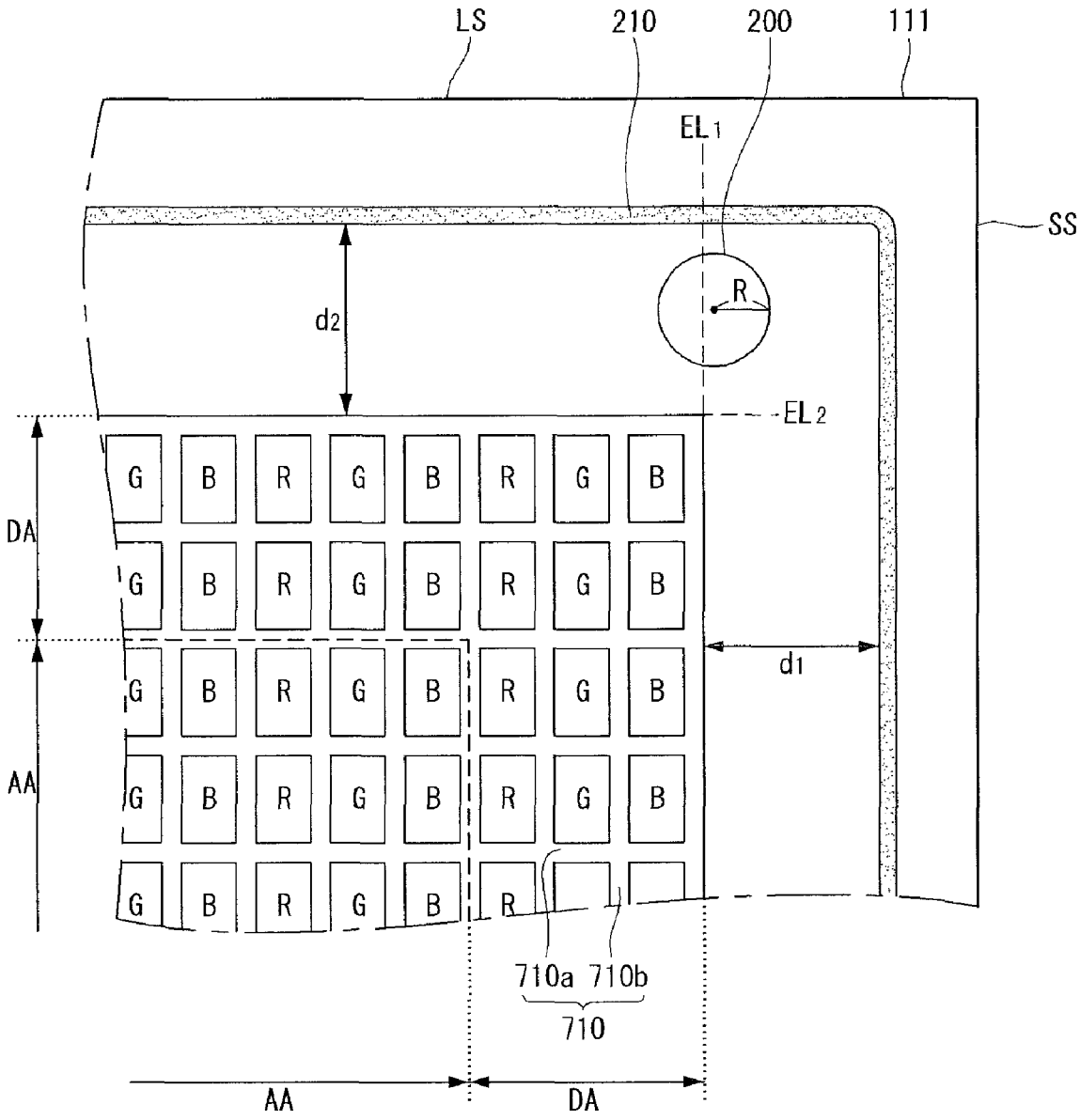

For example, as shown in FIG. 10, the exhaust hole 200 may overlap with an extension line EL1 and/or EL2 of the outermost dummy barrier rib 710 arranged in the dummy area DA.

In this case, the distance d1 and/or d2 between the outermost dummy barrier rib 710 and the seal layer 210 can be decreased, thus enabling a further reduction of the size of the bezel area. For example, in FIG. 10, the exhaust hole 200 may overlap with the first extension line EL1 of the outermost dummy barrier rib 710 in a direction parallel to the short side SS of the rear substrate 111. In this case, it is possible to reduce the size of the distance d1 between the seal layer 210 and the outermost barrier rib 112 in a direction parallel to the first electrodes, that is, in a direction parallel to the long side LS of the rear substrate 111.

Meanwhile, the distance between the outermost barrier rib 112 (in the case where the outermost dummy barrier rib 710 is arranged) and the seal layer 210 may be varied according to position.

Figure 11:
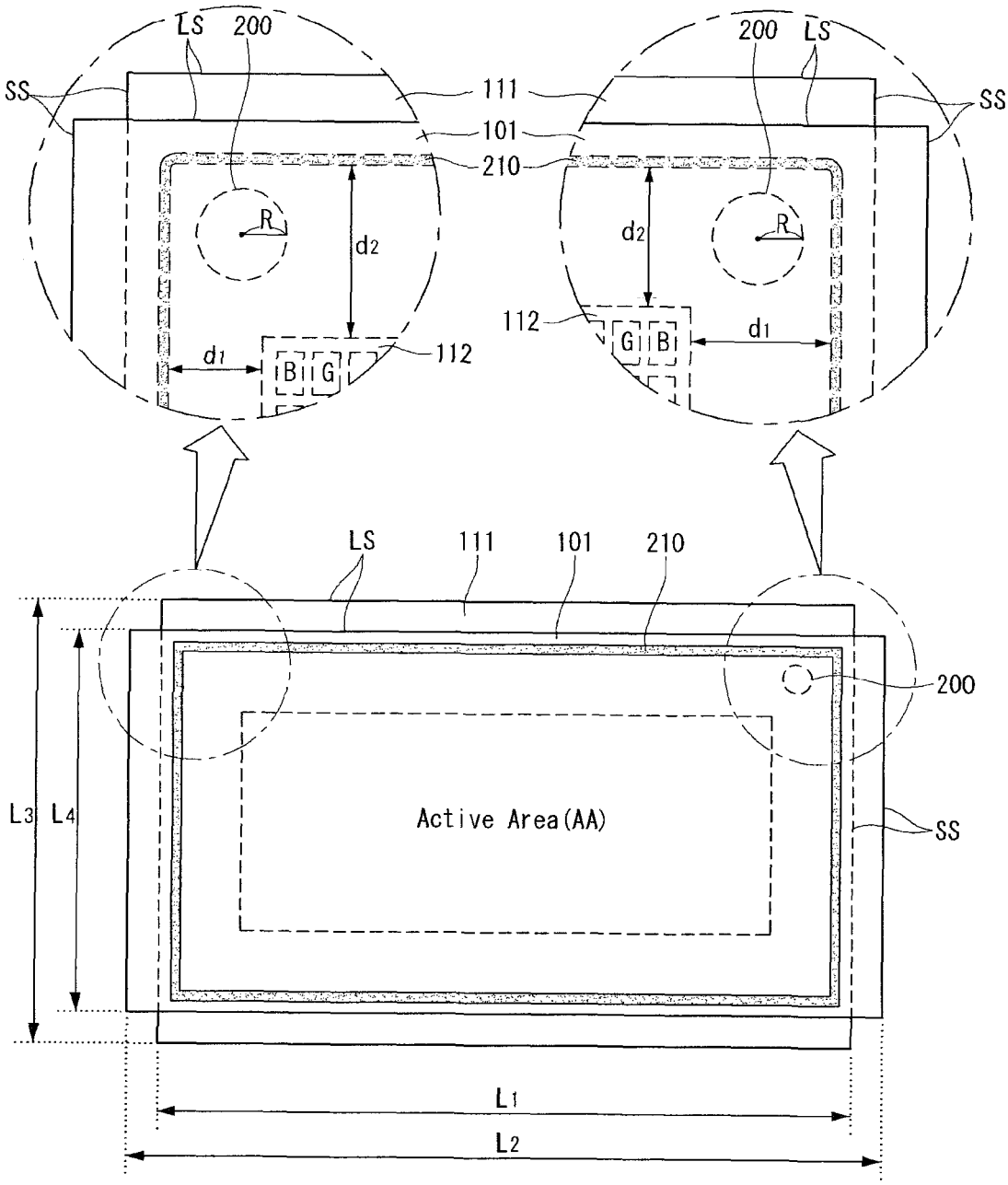

For example, as shown in FIG. 11, the distance d1, parallel to the first electrodes, i.e., the long side LS of the rear substrate 111, between the seal layer 210 and the outermost barrier rib 112 (or the outermost dummy barrier rib 710) may be less than the distance d2, parallel to the second electrodes, i.e., the short side SS of the rear substrate 111, between the seal layer 210 and the outermost barrier rib 112 (or the outermost dummy barrier rib 710).

The transverse length (long side length) of the plasma display panel is larger than the longitudinal length (short side length) thereof. This is to provide screen ratios of 16:9, 4:3, 21:9, etc.

Hence, though human eyes are able to easily perceive an increase in the transverse length of the panel, they are very likely not to be able to perceive a slight increase in the longitudinal length thereof.

Considering this, it may be preferable that the distance d1, parallel to the first electrodes, between the seal layer 210 and the outermost barrier rib 112 (or the outermost dummy barrier rib 710) is set smaller than the distance d2, parallel to the second electrodes, between the seal layer 210 and the outermost barrier rib 112 (or the outermost dummy barrier rib 710) in terms of a visual effect that makes an image stand out.

Also, if the distance d2, parallel to the second electrodes, between the seal layer 210 and the outermost barrier rib 112 (or the outermost dummy barrier rib 710) is set larger than the distance d1, parallel to the first electrodes, between the seal layer 210 and the outermost barrier rib 112 (or the outermost dummy barrier rib 710), this makes it easier to arranged the exhaust hole 200 in a manner as shown in FIG. 10.

Referring to FIG. 11, the distance d1, parallel to the first electrodes, between the outermost barrier rib 112 (or the outermost dummy barrier rib 710) and the seal layer 210 may be less than the circumferential length of the exhaust hole 200, while the distance d2, parallel to the second electrodes, between the outermost barrier rib 112 (or the outermost dummy barrier rib 710) and the seal layer 210 may be greater than the circumferential length of the exhaust hole 200.

In this case, too, the distances d1 and d2, parallel to the first electrodes and the second electrodes, respectively, between the outermost barrier rib 112 and the seal layer 210 may be larger than the diameter of the exhaust hole 200.

Figure 12:
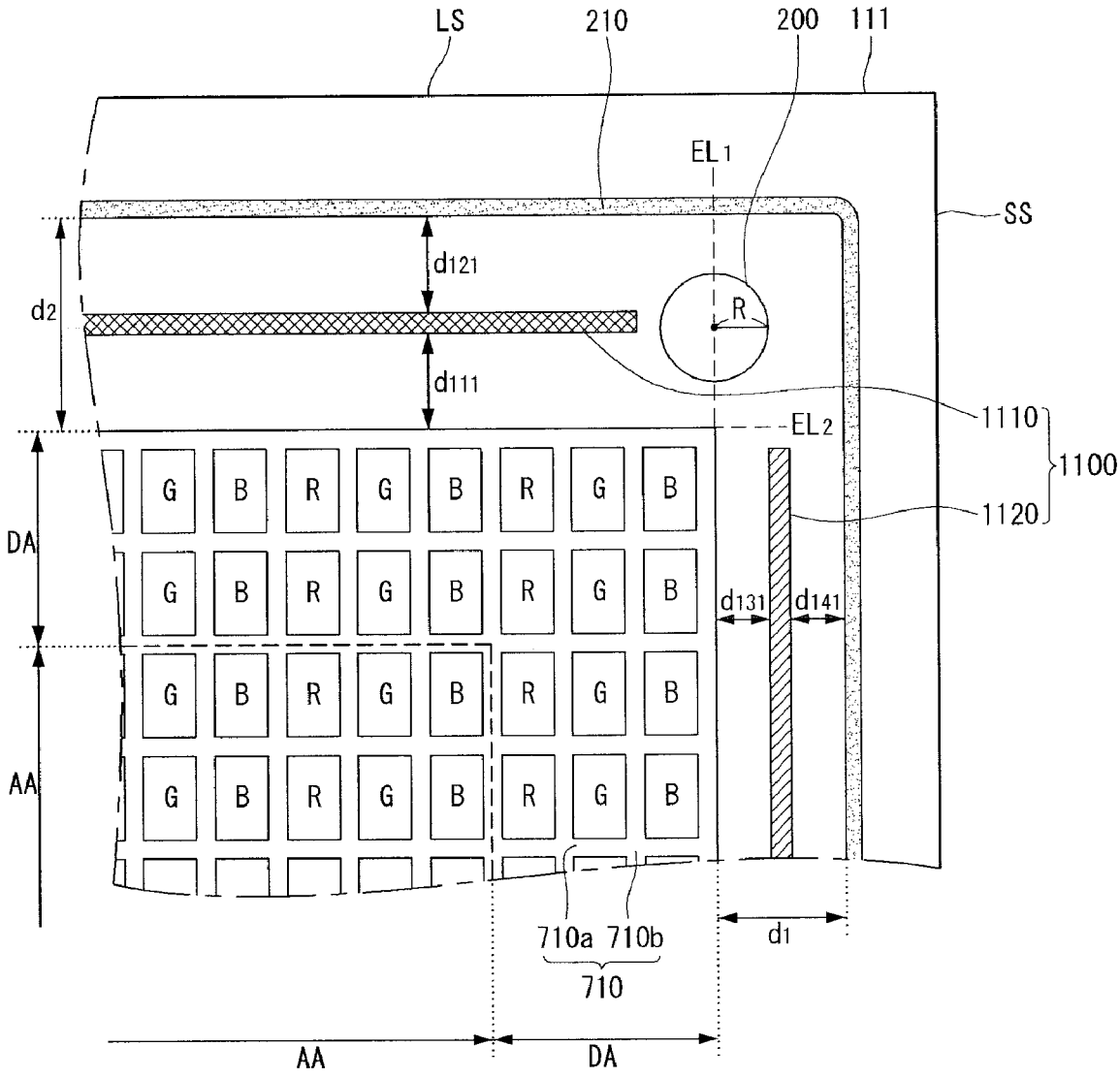

Meanwhile, even when the separation barrier rib 1100 is arranged, the exhaust hole 200 and an extension line of the outermost barrier rib 112 may overlap with each other. For example, as shown in FIG. 12, the first separation barrier rib 1110 parallel to the long side LS of the rear substrate 111 is arranged between the first dummy barrier rib 710*a* of the dummy barrier ribs 710 and the seal layer 210, and the second separation barrier rib 1120 parallel to the short side SS of the rear substrate 111 may be arranged between the second dummy barrier rib 710*b* of the dummy barrier ribs 710 and the seal layer 210. Here, the exhaust hole 200 may overlap with the first extension line EL1 of the outermost dummy barrier rib 710 in a direction parallel to the short side SS of the rear substrate 111. That is, the exhaust hole 220 may overlap with the dummy barrier ribs 710 in a direction parallel to the short side SS of the rear substrate 111.

In the structure of FIG. 12, similarly to FIG. 11, if the distance d1, parallel to the first electrodes, i.e., the long side LS of the rear substrate 111, between the seal layer 210 and the outermost barrier rib 112 (or the outermost dummy barrier rib 710) is less than the distance d2, parallel to the second electrodes, i.e., the short side SS of the rear substrate 111, between the seal layer 210 and the outermost barrier rib 112 (or the outermost dummy barrier rib 710), the sum of the distance d131 between the outermost dummy barrier rib 710 and the second separation barrier rib 1120 and the distance d141 between the second separation barrier rib 1120 and the seal layer 210, which is measured parallel to the first electrodes, may be less than the circumferential length of the exhaust hole 200. On the contrary, the sum of the distance d121 between the outermost dummy barrier rib 710 and the first separation barrier rib 1120 and the distance d131 between the first separation barrier rib 1110 and the seal layer 210, which is measured parallel to the second electrodes, may be greater than the circumferential length of the exhaust hole 200.

Figure 13:
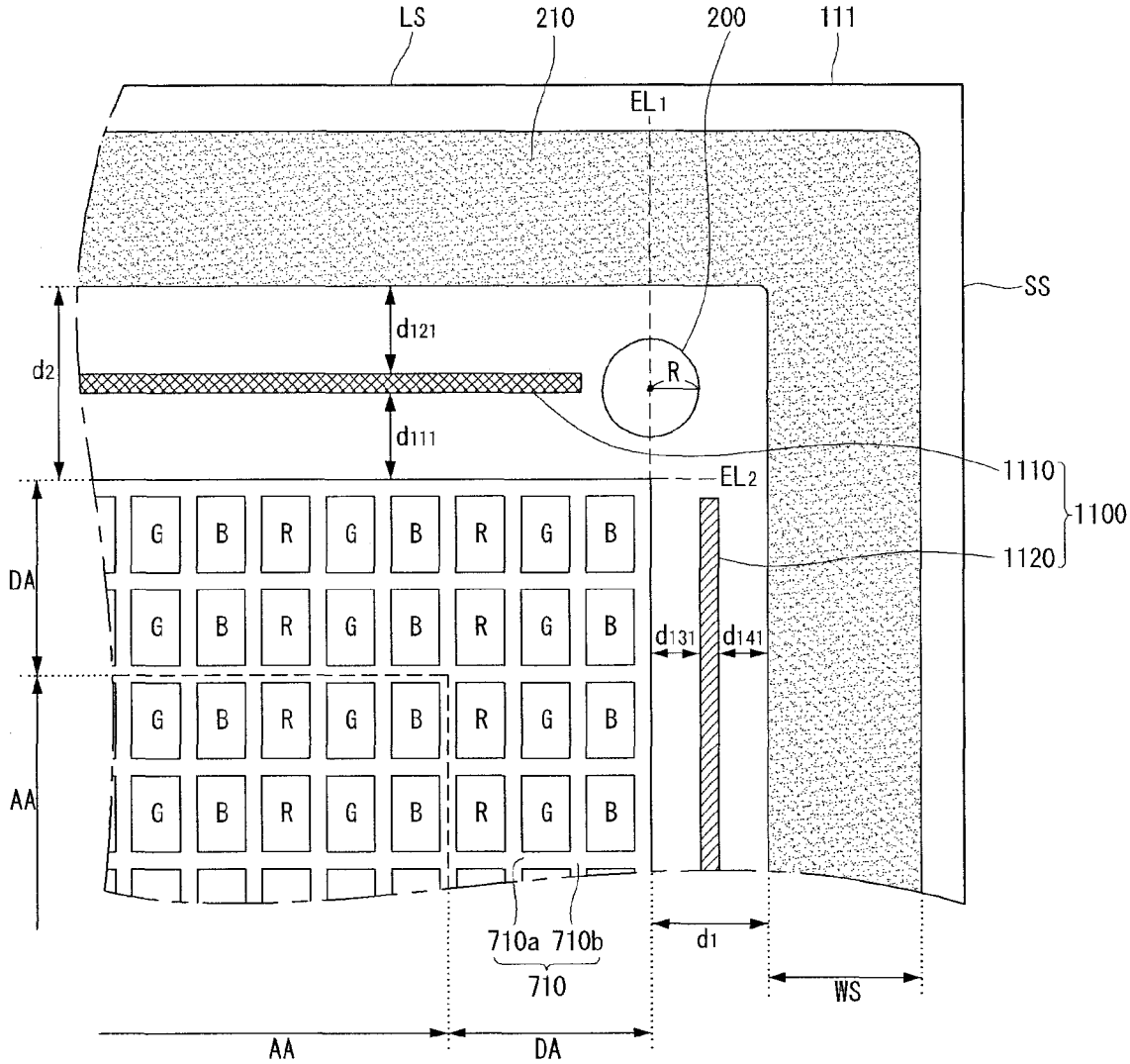

Meanwhile, the width of the seal layer 200 may be greater than the distance between the outermost barrier rib 112 (or the outermost dummy barrier rib 710) and the seal layer 210. For example, as shown in FIG. 13, the width Ws of the seal layer 210 may be greater than the distance d1, parallel to the first electrodes, between the outermost dummy barrier rib 710 and the seal layer 210. While the preceding drawings have illustrated that the width Ws of the seal layer 210 is relatively small for the convenience of explanation, the width Ws of the seal layer 210 may be sufficiently large as shown in FIG. 13.

As such, if the width Ws of the seal layer 200 is made larger than the distance between the outermost barrier rib 112 (or the outermost dummy barrier rib 710) and the seal layer 210, the size of the bezel area can be reduced.

FIGS. 14 to 22 are diagrams for explaining the arrangement of open dummy barrier ribs. The description of the parts having been described above in detail will be omitted below. For instance, in the following discussion, the width of the seal layer 210 is illustrated to be relatively small for the convenience of explanation.

Figure 14:
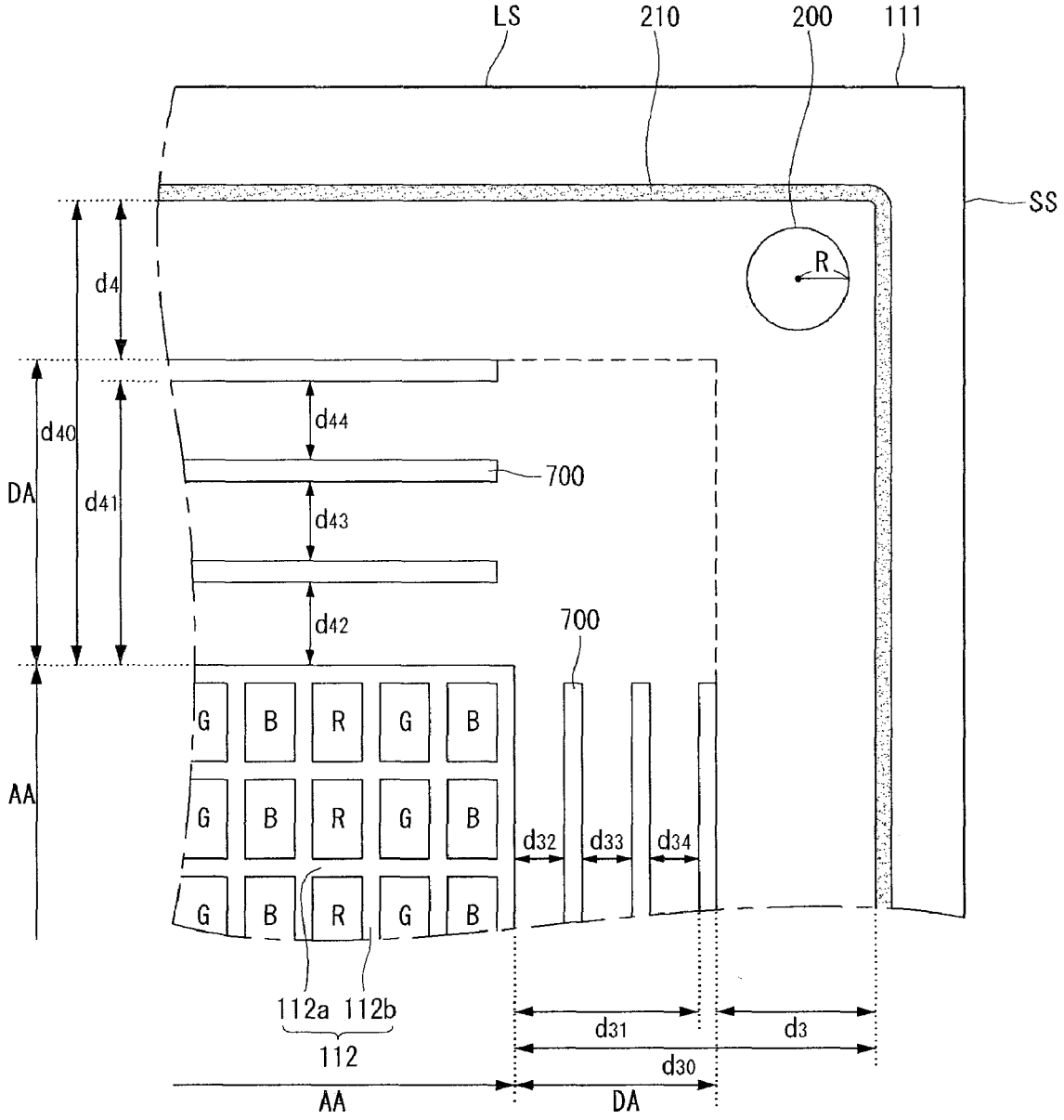
FIGS. 14 to 22 are diagrams for explaining the arrangement of open dummy barrier ribs.

Referring to FIG. 14, at least one open barrier rib 700 may be arranged in a dummy area DA outside an active area AA. By arranging the open barrier rib 700 in the dummy area DA, the size of a bezel area can be reduced and exhaust characteristics can be further improved. That is, dummy barrier ribs have an open structure.

At least one open barrier rib 700 having a stripe shape may be arranged in the dummy area DA.

In this case, the outermost barrier rib is the open barrier rib 700 arranged in an outermost portion of the dummy area DA.

Barrier rib 112 formed in the active area may be closed barrier ribs. The closed barrier ribs 112 may comprise horizontal barrier ribs 112*a* and longitudinal barrier ribs 112*b* that cross each other.

When the open dummy barrier ribs 710 are formed in the dummy area DA, a buffer zone can be provided between the active area AA and the seal layer 210, thereby preventing damage of the active barrier ribs 112 formed in the active area AA and improving discharge characteristics of the discharge cells partitioned by the active barrier ribs 112.

Moreover, to increase the buffering effect of the open barrier ribs 700 to a sufficiently high level, it may be preferable that the distance d33, d34, d43, and d44 between two adjacent open barrier ribs 700 is less than the distance d3 and d4 between the outermost open barrier rib 700 and the seal layer 210.

Also, it may be preferable that the distance d32 and d42 between the outermost barrier rib 112 formed in the active area AA and the first open barrier rib 700 is less than the distance d3 and d4 between the outermost open barrier rib 700 and the seal layer 210.

Moreover, the distance d43 and d44 between two open barrier ribs adjacent to each other in the dummy area of the long sides LS of the front substrate 101 and rear substrate 111 may be substantially equal to a longitudinal width (any one of W4, W5, and W6) of at least one discharge cell formed in the active area AA, i.e., a width (any one of W4, W5, and W6) of at least one discharge cell in a direction of the short sides SS of the front substrate 101 and rear substrate 111.

Further, the distance d33 and d34 between two open barrier ribs adjacent to each other in the dummy area of the short sides SS of the front substrate 101 and rear substrate 111 may be substantially equal to a transverse width (any one of W1, W2, and W3) of at least one discharge cell formed in the active area AA, i.e., a width (any one of W1, W2, and W3) of at least one discharge cell in a direction of the long sides LS of the front substrate 101 and rear substrate 111.

In this case, it is possible to form open barrier ribs 700 in the dummy area merely by a change of a photo mask pattern, thereby preventing an excessive increase of manufacturing costs.

As shown in FIG. 14, in the case where at least one open barrier rib 700 is arranged in the dummy area DA outside the active area AA, the distance d3 and d4 between the seal layer 210 and the outermost open barrier rib 700 may be less than the distance d31 and/or d41 between the outermost open barrier rib 700 and the outermost active barrier rib 112. In this case, the size of the bezel area can be further reduced. Of course, the distance d3 and d4 between the seal layer 210 and the outermost open barrier rib 700 may be greater than the distance d31 and/or d41 between the outermost open barrier rib 700 and the outermost active barrier rib 112.

Moreover, the distance d3 and/or d4 between the outermost barrier rib 700 and the seal layer 210 may be less than the circumferential length of the exhaust hole.

As above, if at least one of d3 and d4 is set smaller than the circumferential length of the exhaust hole 200, the size of the bezel can be reduced. Also, an excessive increase in the processing time during the exhaust process or the gas injection process can be prevented.

Further, in the case where the open barrier ribs 700 are arranged in the dummy area DA, it may be preferable that the distance d31 and/or d41 between the outermost closed barrier rib 112 arranged in the active area AA and the outermost open barrier rib 700 arranged in the dummy area DA is set smaller than the circumferential length of the exhaust hole 22 in order to prevent an increase in the size of the bezel area.

In addition, the sum d31+d3 and/or d41+d4 of the distance d3 and d4 between the outermost open barrier rib 700 and the seal layer 210 and the distance d31 and d41 between the outermost closed barrier rib 112 arranged in the active area AA and the outermost open barrier rib 700 arranged in the dummy area DA may be greater than the circumferential length of the exhaust hole 200.

That is, the total distance d30 and/or d40 from the active area AA to the seal layer 210 may be greater than the circumferential length of the exhaust hole 200.

In this case, since a path through which the gas in the panel can pass can be secured sufficiently in the dummy area DA as well, the distance d3 and/or d4 between the outermost open barrier rib 700 and the seal layer 210 may be set smaller in order to reduce the size of the bezel area. Also, even if the distance d3 and/or d4 between the outermost open barrier rib 700 and the seal layer 210 is set substantially equal to or less than the circumferential length of the exhaust hole 200, degradation of the exhaust characteristics can be prevented.

As above, a path through which gas can pass is provided between the open barrier ribs 700 and the closed barrier ribs 112, thus improving the exhaust characteristics.

From the viewpoint of the path through which gas can pass, a width of the remaining portion, excluding the portion occupied by the open barrier ribs 700, of the region d30 and/or d40 from the active area AA and the seal layer 210 may be greater than the circumferential length of the exhaust hole 200.

For example, as shown in FIG. 14, in the case where a plurality of open barrier ribs 700 are arranged in the dummy area DA, the sum d33+d34 and/or d43+d44 of the distance between two adjacent open barrier ribs 700 and the sum d32+d33+d34 and/or d42+d43+d44 of the distance d32 and/or d42 between the outermost closed barrier rib 112 and an adjacent open barrier rib may be greater than the circumferential length of the exhaust hole 200.

Alternatively, since the path through which gas can pass is formed by the open barrier ribs 700 in the dummy area DA, the distance d3 and/or d4 between the outermost open barrier rib 700 and the seal layer 210 may be set smaller, and, as a result, the sum d33+d34 and/or d43+d44 of the distance between the two adjacent open barrier ribs 700 and the sum d32+d33+d34 and/or d42+d43+d44 of the distance d32 and/or d42 between the outermost closed barrier rib 112 and the adjacent open barrier rib may be made smaller than the circumferential length of the exhaust hole 200.

Moreover, the distance D3 and/or D4 between the outermost open barrier rib 700 and the seal layer 210 may be less than the distance D31 and/or D41 between the outermost closed barrier rib 112 and the outermost open barrier rib 700.

As shown in FIG. 14, in the case where at least one open barrier rib 700 Is arranged in the dummy area DA, a path through which gas can pass is provided in the dummy area as well, thereby enabling a further decrease in the size of the bezel area by reducing the distance between the outermost open barrier rib 700 and the seal layer 210.

Meanwhile, if the distance between the outermost open barrier rib 700 and the seal layer 210 is excessively large, with the circumferential length of the exhaust hole 200 being fixed, the size of an unnecessary area, i.e., the size of the bezel, becomes excessively large, thus increasing manufacturing costs.

Figure 15:
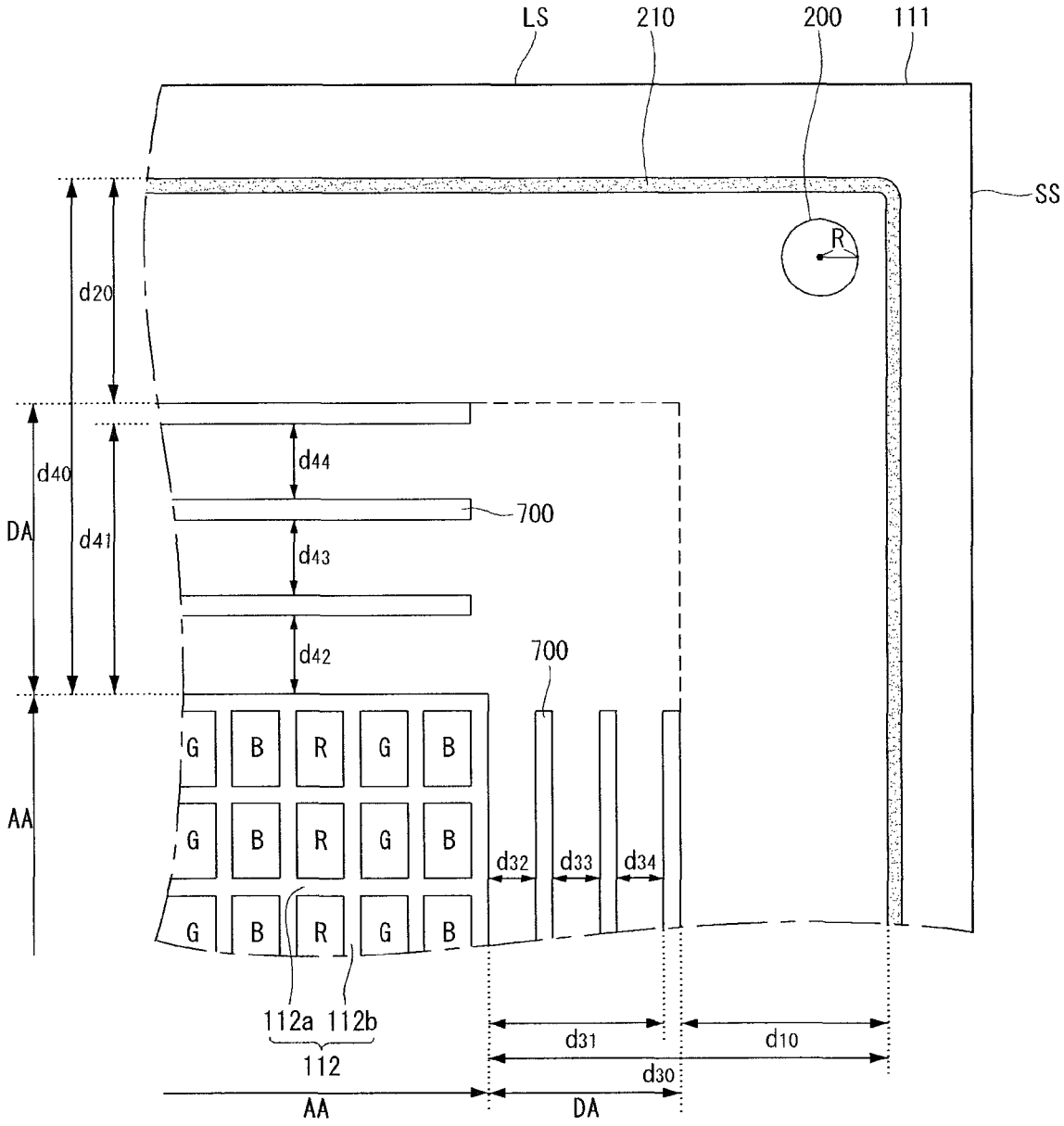

For example, it is assumed that, as shown in FIG. 14, the distance d3 and/or d4 between the outermost open barrier rib 700 and the seal layer 210 is substantially equal to the circumferential length of the exhaust hole 200 in the second exemplary embodiment according to the present invention, and as shown in FIG. 15, the distance d10 and/or d20 between the outermost open barrier rib 700 and the seal layer 210 is approximately twice as large as the circumferential length of the exhaust hole 200 in a second comparative example.

The exhaust characteristics of the second exemplary embodiment and the second comparative example will be discussed with reference to FIG. 16.

Here, the times required to exhaust the gas in the panel to a vacuum pump and reduce the internal pressure to a critical degree of vacuum in the second exemplary embodiment and the second comparative example are measured. The critical degree of vacuum is set to approximately $2.1\times10^{-21}$.

Figure 16:
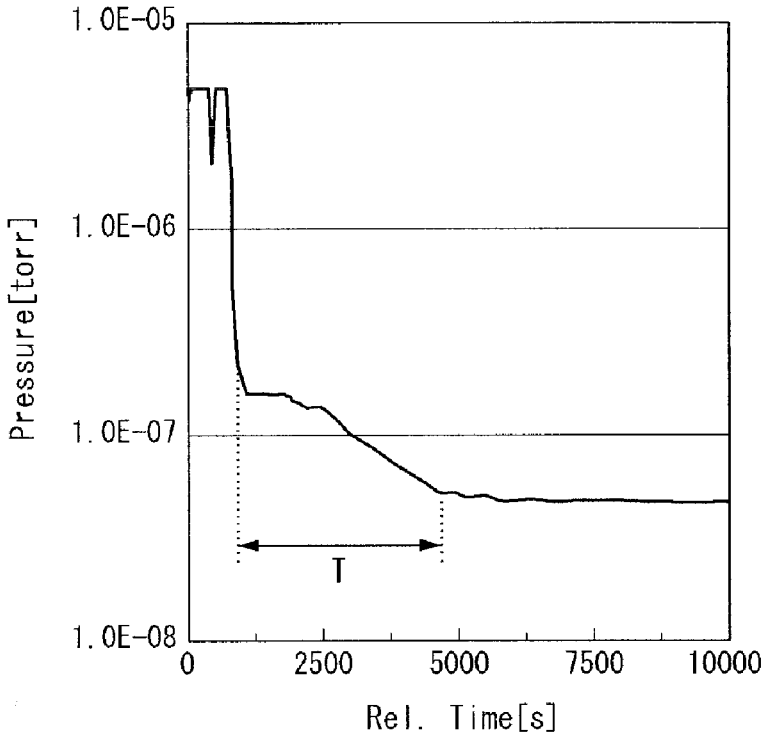
Figure 16:
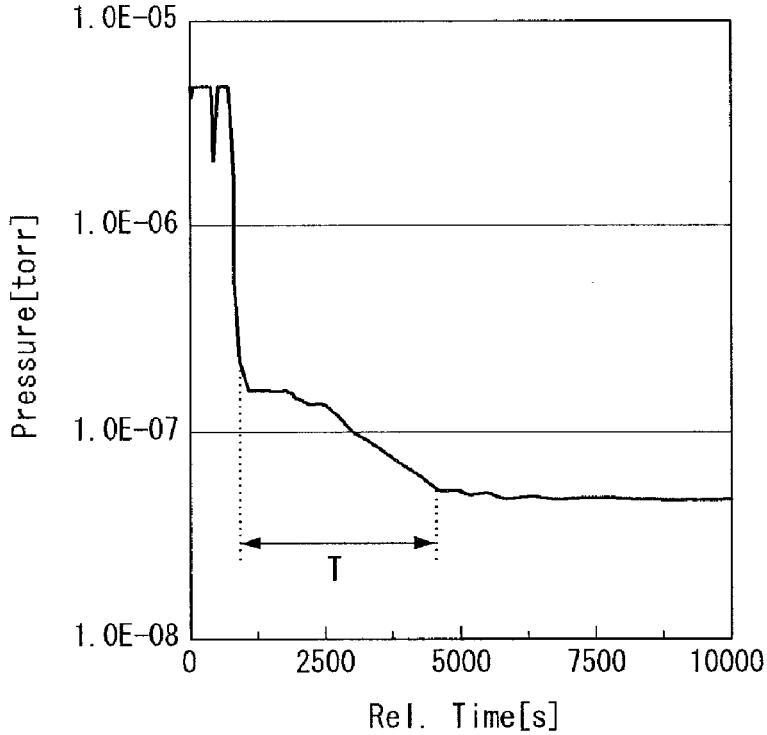

Referring to (a) of FIG. 16, it can be seen that, in the second comparative example, the time (t) required for the internal pressure of the panel to reach the critical degree of vacuum from a point of time when the vacuum pump is operated to start sucking impurity gases in the panel is approximately 220 minutes Referring to (b) of FIG. 16, it can be seen that, in the second exemplary embodiment according to the present invention, the time (t) required for the internal pressure of the panel to reach the critical degree of vacuum from a point of time when the vacuum pump is operated to start sucking impurity gases in the panel is approximately 225 minutes, which is substantially at an equal level to that of the second comparative example.

In comparing (a) and (b) of FIG. 16, in the second comparative example, it can be seen that an unconditional increase in the distance d10 and/or d20 between the outermost barrier rib 112 and the seal layer 210 as shown in FIG. 15 may only lead to an increase in the size of the bezel area without significant improvement in the exhaust characteristics. That is, as shown in FIG. 14, if the distance d3 and/or d4 between the outermost open barrier rib 700 and the seal layer 210 is substantially equal or less than the circumferential length of the exhaust hole 200, the exhaust characteristics can be maintained at an equal level to those of the second comparative example and the size of the bezel area can be reduced.

The open barrier ribs 700 may be arranged on the long sides LS or short sides SS of the front substrate 101 and rear substrate 111, or may be arranged on the long sides LS and short sides SS, respectively, of the front substrate 101 and rear substrate 111.

Figure 17:
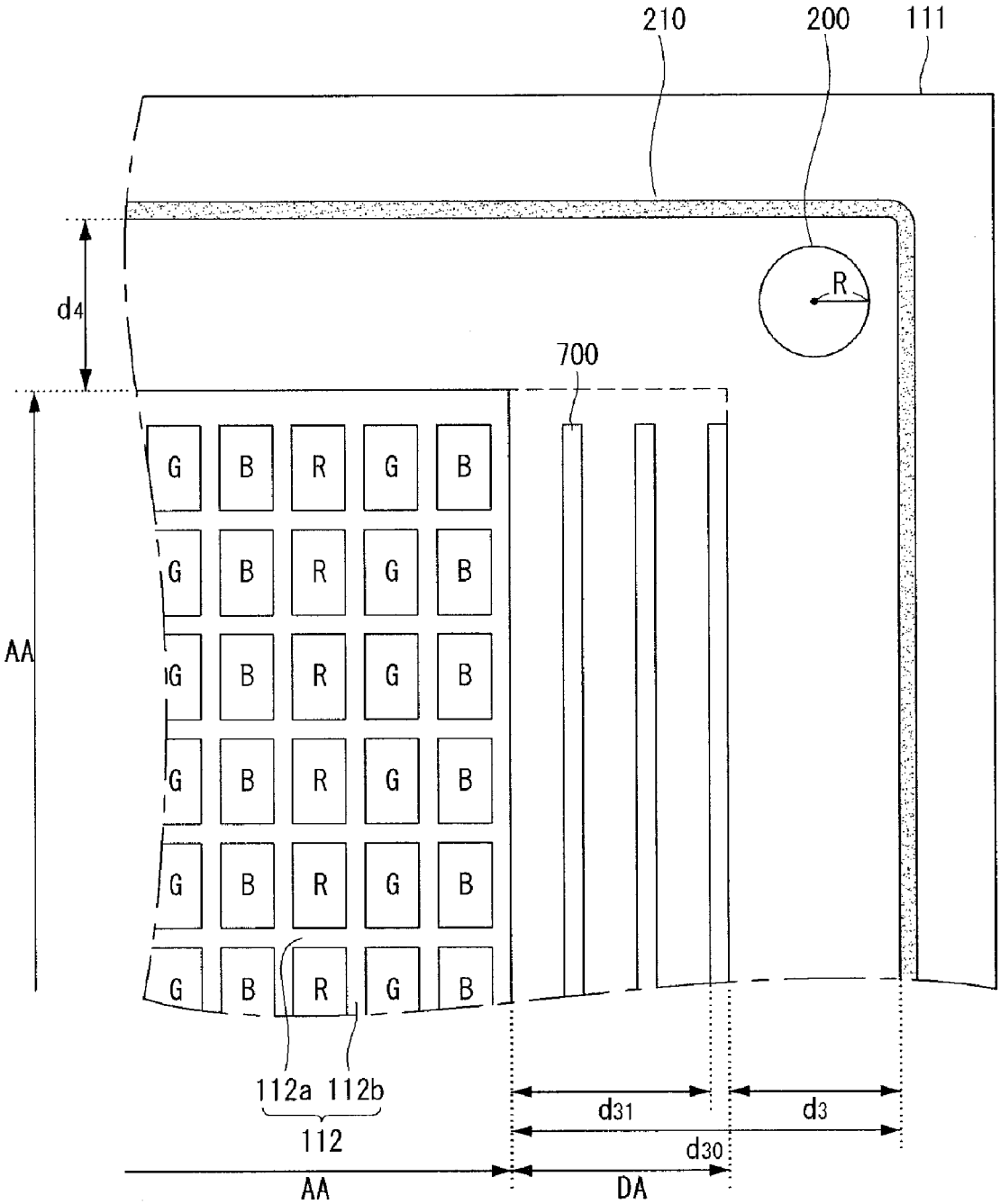

For example, as shown in FIG. 17, the open barrier ribs 700 may be arranged in the dummy area DA on the short sides SS of the front substrate 101 and rear substrate 111.

Figure 18:
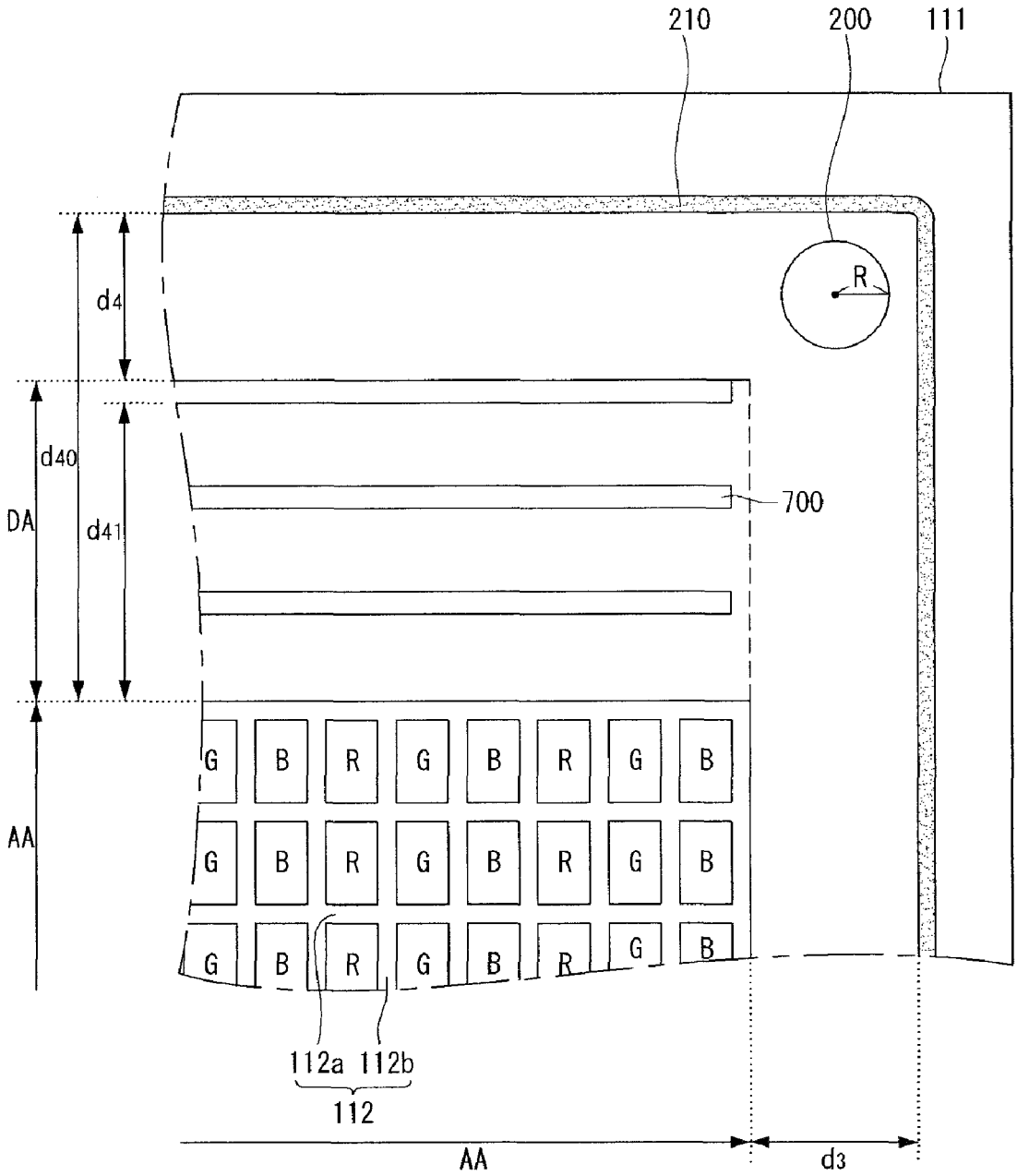

Alternatively, as shown in FIG. 18, the open barrier ribs 700 may be arranged in the dummy area DA on the long sides LS of the front substrate 101 and rear substrate 111.

Figure 19:
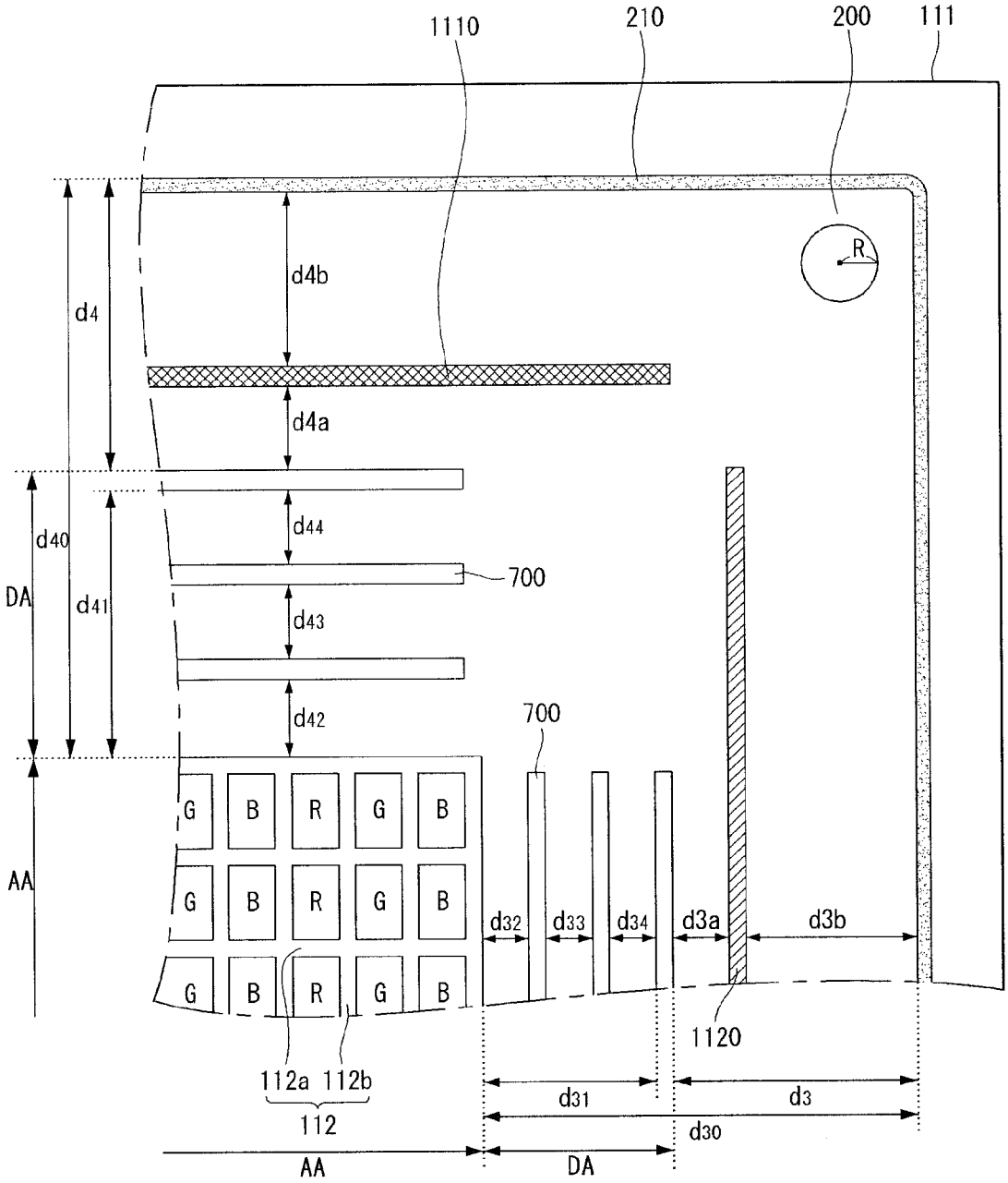

Referring to FIG. 19, even when the open barrier ribs 700 are arranged in the dummy area DA, the separation barrier rib 1100 may be arranged between the open barrier ribs 700 and the seal layer 210.

Also, the separation barrier rib 1100 may be spaced apart from the open barrier ribs 700.

In the case where the separation barrier rib 1100 is formed as above, the distance d3 and/or d4 between the outermost open barrier rib 700 and the seal layer 210 may be less than the circumferential length of the exhaust hole 200. Moreover, the sum d3*a*+d3*b* and/or d4*a*+d4*b* of the distance d3*a* and d4*a* between the outermost open barrier rib 700 and the separation barrier rib 1100 and the distance d3*b* and d4*b* between the separation barrier rib 1100 and the seal layer 210 may be less than the circumferential length of the exhaust hole 200.

Meanwhile, the closed barrier ribs and the open barrier ribs may be arranged together in the dummy area DA. Therefore, at least one dummy discharge cell may be formed.

Figure 20:
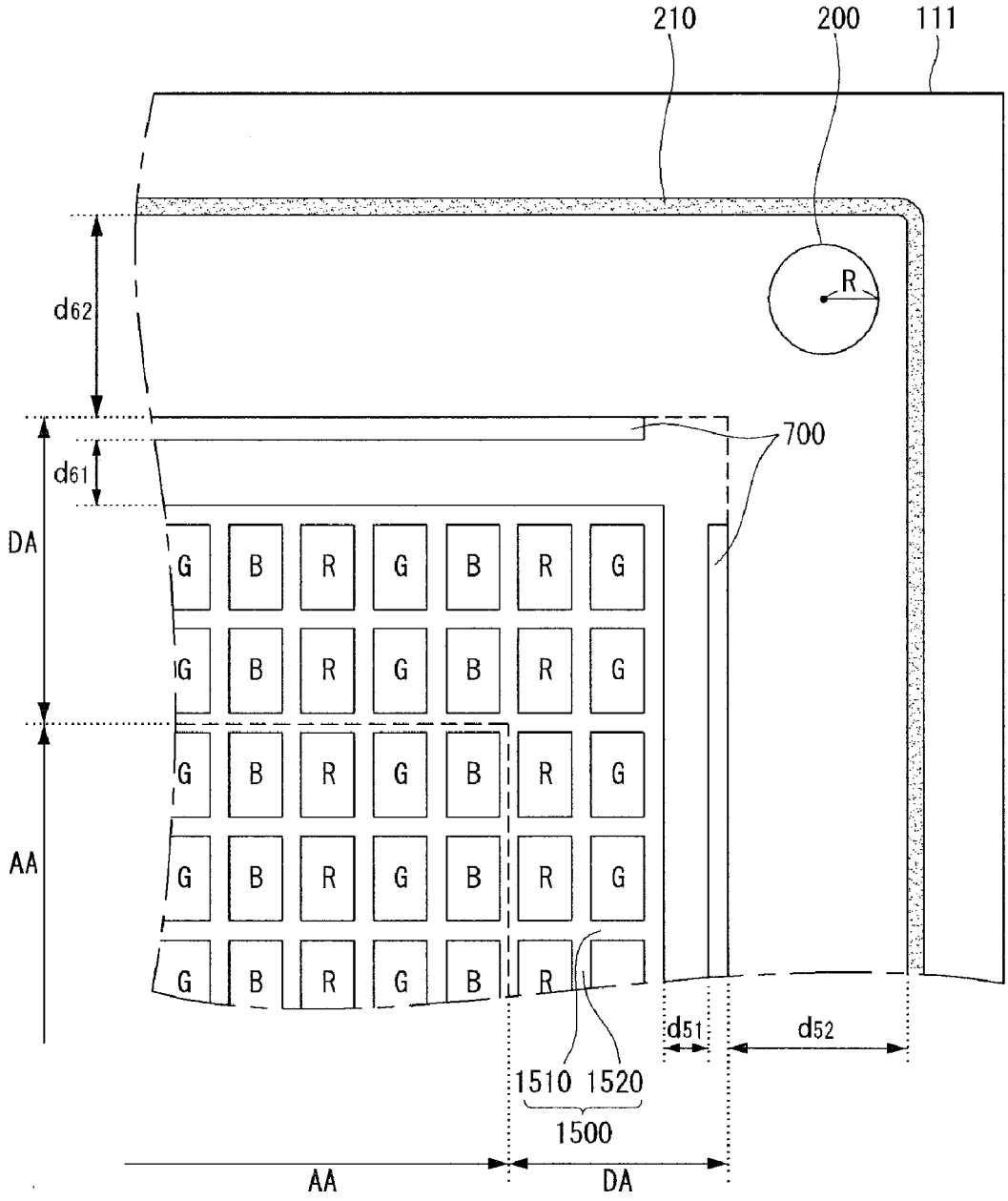

To this end, as shown in FIG. 20, at least one of the dummy barrier ribs arranged in the dummy area DA may be a closed dummy barrier rib 1500.

The closed dummy barrier rib 1500 may comprise a dummy transverse barrier rib 1510 and a dummy longitudinal barrier rib 1520.

When a dummy discharge cell is formed in the dummy area DA as above, the stability of discharge in the active discharge cells partitioned, by the active barrier ribs 112 in the active area can be further improved.

Also, even when at least one dummy discharge cell is formed in the dummy area DA, it may be preferable that at least one open barrier rib 700 is arranged in the dummy area DA.

In this case, it may be preferable that the sum d51+d52 and/or d61+d62 of the distance d51 and d61 between the closed dummy barrier rib 1500 and the open barrier rib 700 and the distance d52 and d62 between the open barrier rib 700 and the seal layer 210 is greater than the circumferential length of the exhaust hole 200.

Figure 21:
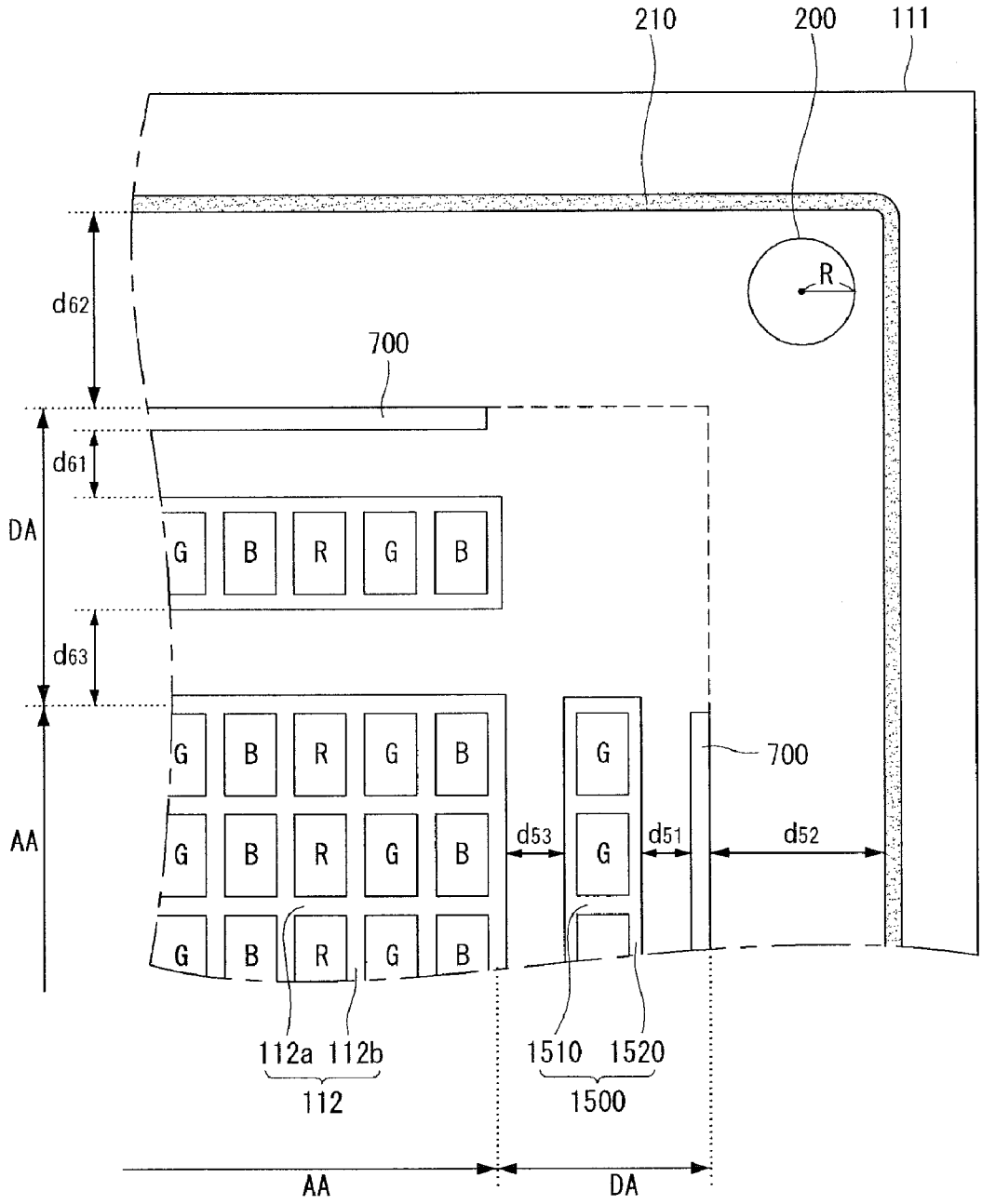

Alternatively, as shown in FIG. 21, the closed dummy barrier rib 1500 for partitioning the dummy discharge cell in the dummy area DA may be spaced apart from the active barrier ribs 112 by a predetermined distance d53 and d63.

In this case, it may be preferable that the sum d51+d52+d53 and/or d61+d62+d63 of the distance d53 and d63 between the active barrier ribs 112 and the closed dummy barrier rib 1500, the distance d51 and d61 between the closed dummy barrier rib 1500 and the opened barrier rib 700, and the distance d52 and d62 between the open barrier rib 700 and the seal layer 210 is greater than the circumferential length of the exhaust hole 200.

Figure 22:
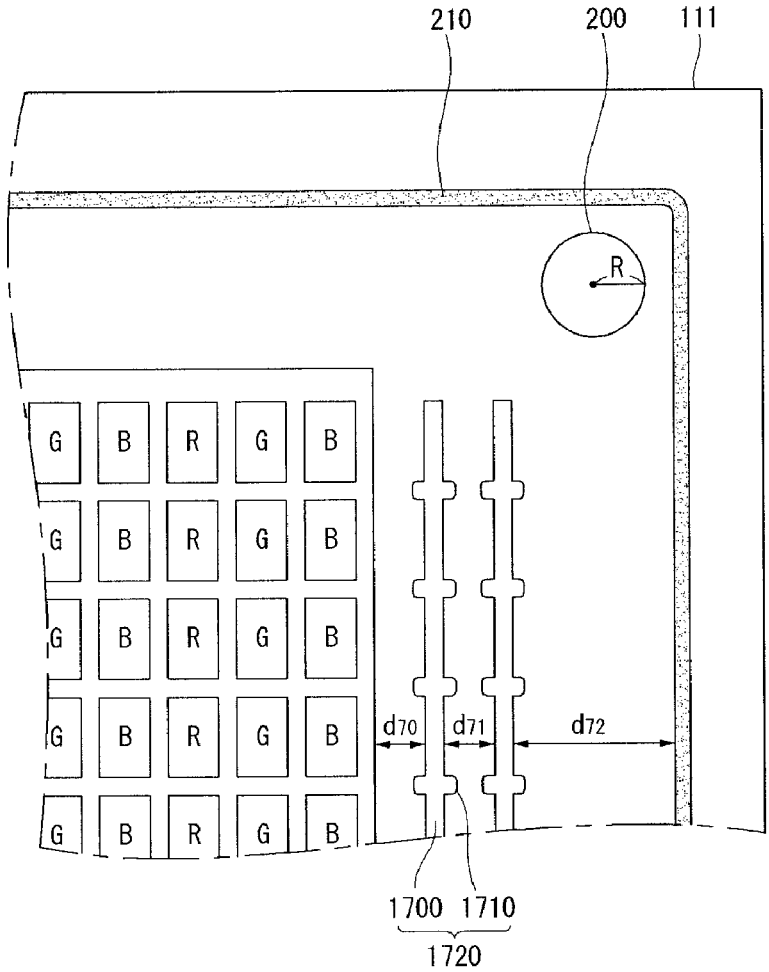

Alternatively, as shown in FIG. 22, open barrier ribs 1720 arranged in the dummy area DA may comprise a first portion 1700 having a stripe shape and parallel to the long sides LS or short sides SS of the front substrate 101 and rear substrate 111 and a second portion 1710 projecting from the first portion 1700.

Although FIG. 22 shows the case where the open barrier ribs 1720 is arranged on the short sides SS of the front substrate 101 and rear substrate 111, the open barrier ribs 1720 may be arranged on the long sides LS of the front substrate 101 and rear substrate 111.

In the above-described structure, it may be preferable that the sum d71+d72+d73 of the distance 70 between the active barrier ribs 112 and the open barrier ribs 1720, the distance d71 between the two open barrier ribs 1720, and the distance d72 between the outermost open barrier rib 1720 and the seal layer 210 is greater than the circumferential length of the exhaust hole 200.

Figure 23:
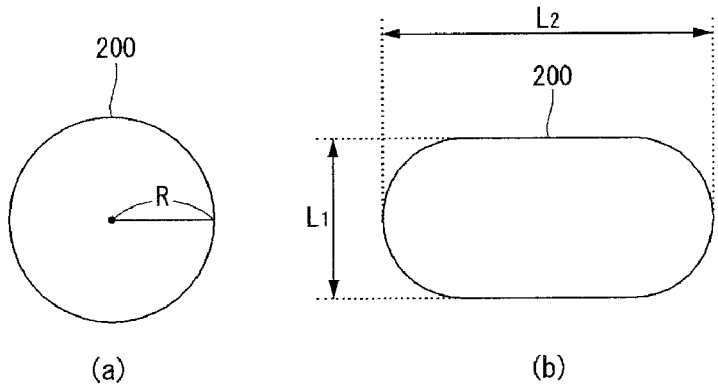
FIG. 23 is a diagram for explaining the shape of the exhaust hole.

FIG. 23 is a diagram for explaining the shape of the exhaust hole.

Referring to FIG. 23, the exhaust hole 200 may have a spherical shape with a radius of R as shown in (a) or an elliptical shape whose transverse length L2 and longitudinal length L1 are different from each other as shown in (b).

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A plasma display panel comprising:

a front substrate;

a rear substrate arranged to face the front substrate;

barrier ribs for partitioning discharge cells between the front substrate and the rear substrate;

a seal layer for bonding the front substrate and the rear substrate together;

a separation barrier rib arranged between the barrier ribs and the seal layer and spaced apart from the seal layer and the barrier ribs; and an exhaust hole formed on the rear substrate in an area between the barrier ribs and the seal layer, wherein the sum of a distance between the outermost barrier rib and the separation barrier rib and a distance between the separation barrier rib and the seal layer is less than a circumferential length of the exhaust hole.

2. The plasma display panel of claim 1, wherein active barrier ribs for partitioning active discharge cells are arranged in an active area between the front substrate and the rear substrate and dummy barrier ribs for partitioning dummy discharge cells are arranged in a dummy area outside the active area, and the sum of the distance between the outermost dummy barrier rib and the separation barrier rib and the distance between the separation barrier rib and the seal layer is less than the circumferential length of the exhaust hole.

3. The plasma display panel of claim 1, wherein the distance between the outermost barrier rib and the seal layer is less than a width of the seal layer.

4. The plasma display panel of claim 1, wherein the distance between the outermost barrier rib and the seal layer is greater than a diameter of the exhaust hole.

5. The plasma display panel of claim 1, further comprising first electrodes disposed on the front substrate and second electrodes disposed on the rear substrate, wherein a distance, parallel to the first electrodes, between the outermost barrier rib and the seal layer is less than a distance, parallel to the second electrodes, between the outermost barrier rib and the seal layer.

6. The plasma display panel of claim 5, wherein the distance, parallel to the first electrodes, between the outermost barrier rib and the seal layer is less than a width of the seal layer.

7. The plasma display panel of claim 5, wherein the distance, parallel to the first electrodes and the second electrodes, between the outermost barrier rib and the seal layer is greater than a diameter of the exhaust hole.

8. The plasma display panel of claim 5, wherein the separation barrier rib comprises:

a first separation barrier rib arranged in parallel to the second electrodes; and a second separation barrier rib arranged in parallel to the first electrodes.

9. The plasma display panel of claim 8, wherein the sum of the distance between the outermost barrier rib and the first separation barrier rib and the distance between the first separation barrier rib and the layer, which is measured parallel to the first electrodes, is less than the circumferential length of the exhaust hole.

10. The plasma display panel of claim 8, wherein the sum of the distance between the outermost barrier rib and the second separation barrier rib and the distance between the second separation barrier rib and the layer, which is measured parallel to the second electrodes, is greater than the circumferential length of the exhaust hole.

* * * * *